US012084938B2

(12) United States Patent
Hult et al.

(10) Patent No.: US 12,084,938 B2
(45) Date of Patent: Sep. 10, 2024

(54) TUBING HANGER WITH TENSIONER MECHANISM

(71) Applicant: EVOLUTION OIL TOOLS INC., Calgary (CA)

(72) Inventors: Vern Hult, Calgary (CA); Bernard Lumori, Calgary (CA); Chris Patton, Calgary (CA); Emery Stoesser, Calgary (CA)

(73) Assignee: EVOLUTION OIL TOOLS INC., Calgary (CA)

( * ) Notice: Subject to any disclaimer, the term of this patent is extended or adjusted under 35 U.S.C. 154(b) by 0 days.

(21) Appl. No.: 17/953,724

(22) Filed: Sep. 27, 2022

(65) Prior Publication Data

US 2023/0121136 A1 Apr. 20, 2023

Related U.S. Application Data

(60) Provisional application No. 63/334,440, filed on Apr. 25, 2022, provisional application No. 63/276,076, filed on Nov. 5, 2021, provisional application No. 63/249,873, filed on Sep. 29, 2021, provisional application No. 63/250,027, filed on Sep. 29, 2021.

(51) Int. Cl.
*E21B 33/04* (2006.01)

(52) U.S. Cl.
CPC ..... *E21B 33/0415* (2013.01)

(58) Field of Classification Search
CPC ..... E21B 33/0415; E21B 23/006
See application file for complete search history.

(56) References Cited

U.S. PATENT DOCUMENTS

| | | | | |
|---|---|---|---|---|
| 4,278,278 | A * | 7/1981 | Chambless | E21B 33/04 29/442 |
| 8,272,434 | B2 * | 9/2012 | Garcia | E21B 33/0415 166/78.1 |
| 9,534,468 | B2 * | 1/2017 | Emmett | E21B 33/04 |
| 9,562,404 | B2 | 2/2017 | Klotz et al. | |
| 10,801,291 | B2 * | 10/2020 | Ross | E21B 17/042 |
| 2003/0024709 | A1 * | 2/2003 | Cuppen | E21B 33/0415 166/85.4 |

FOREIGN PATENT DOCUMENTS

| | | |
|---|---|---|
| CA | 2215755 | 8/1998 |
| CA | 2778244 A1 | 6/2010 |
| CA | 2845974 A1 | 9/2015 |

* cited by examiner

*Primary Examiner* — Aaron L Lembo
(74) *Attorney, Agent, or Firm* — Bennett Jones LLP

(57) ABSTRACT

A tubing hanger includes: a mandrel for connection to a tubing string; an outer hanger body for supporting the mandrel in the well, the mandrel supported in a main bore of the outer hanger body by J-lock mechanisms. The outer hanger body can be supported in the tubing head or in bowl of a tubing rotator.

12 Claims, 18 Drawing Sheets

214

94
217
214
60

214
94
217
214

FIG. 10B
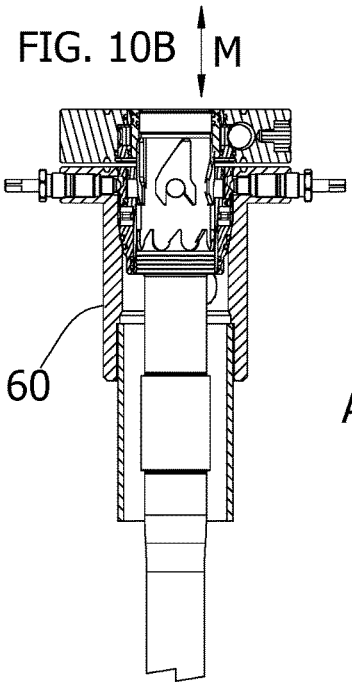
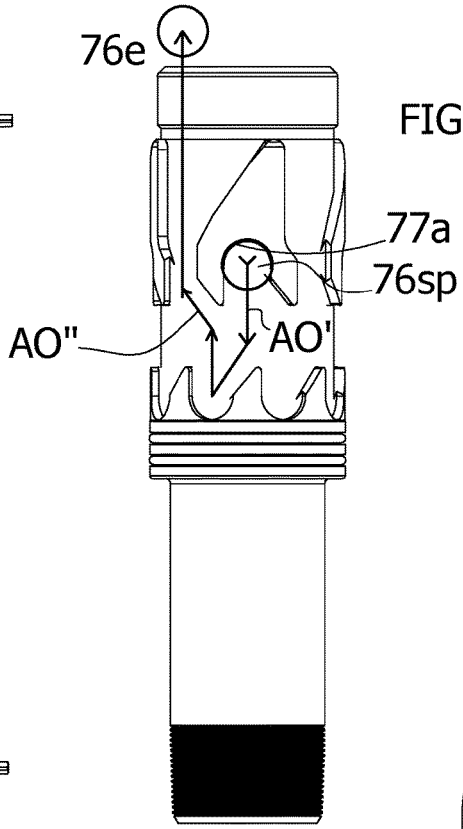
FIG. 10C
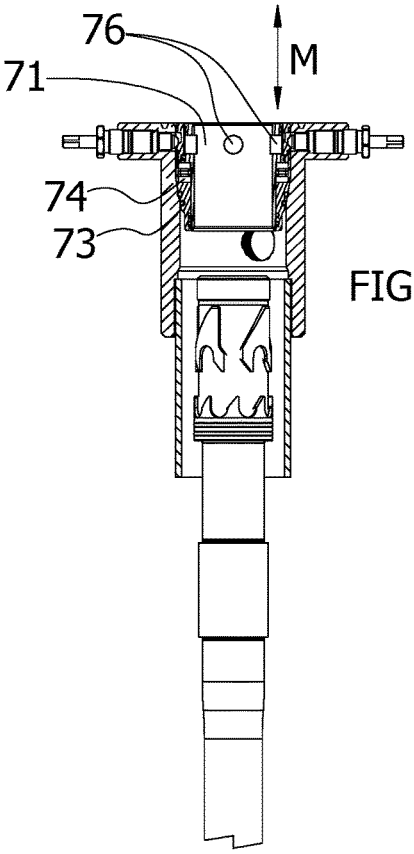
FIG. 10D
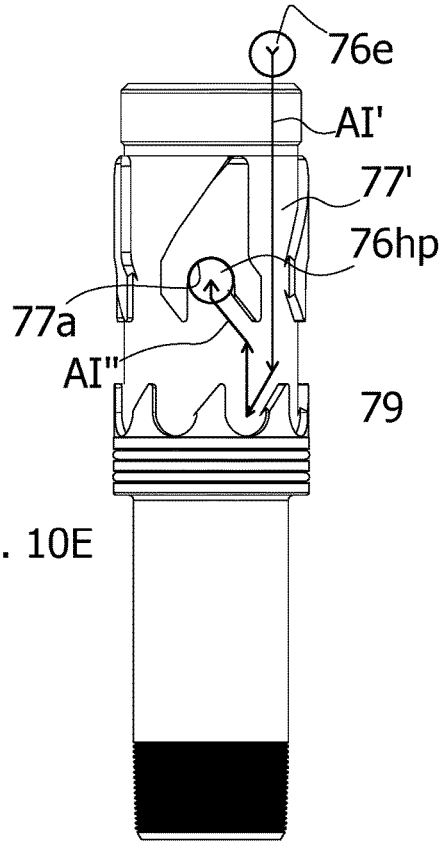
FIG. 10E

TUBING HANGER WITH TENSIONER MECHANISM

FIELD

The present invention relates to a tubing hanger for hanging a tubing string in a well, and more particularly relates to a tubing hanger with a mechanism for reliably tensioning the tubing string.

BACKGROUND

Various types of tubing hangers have been devised for hanging a tubing string in a well.

There are many applications where it is highly desirable to support a tubing string in a well, while still being able to tension the tubing string in the well. Therefore, some tubing hangers can serve a dual purpose of hanging a tubing string, while permitting tensioning thereof.

SUMMARY

In accordance with a broad aspect of the present invention, there is provided a tubing hanger comprising: an outer hanger body for supporting the tubing hanger in a tubing head, the outer hanger body including a support portion, a rotatable portion and a bearing permitting rotation of the rotatable portion relative to the support portion; and a mandrel for connection to a tubing string, the mandrel supported in a main bore of the outer hanger body by J-lock mechanisms between the mandrel and the rotatable portion, the mandrel having an upper end configured for engagement with a tubing rotator.

In accordance with another broad aspect of the present invention, there is provided a tubing hanger comprising: a mandrel for connection to a tubing string; an outer hanger body for supporting the tubing hanger in a tubing head, the mandrel supported in a main bore of the outer hanger body by J-lock mechanisms; and an annular seal to seal against fluid flow up between the outer hanger body and the mandrel, wherein the annular seal remains set when the mandrel is lowered to a tubing string tensioning position.

In accordance with another broad aspect of the present invention, there is provided a tubing hanger comprising: a mandrel for connection to a tubing string; an outer hanger body for supporting the tubing hanger in a tubing head, the mandrel supported in a main bore of the outer hanger body by J-lock mechanisms; and the outer hanger body includes a support portion, a rotatable portion and a bearing permitting rotation of the rotatable portion relative to the support portion, and wherein the rotatable portion includes a sleeve extension extending down within a bore of the support portion and the bearing is enclosed between the rotatable portion and the support portion and radially outwardly and behind the sleeve extension.

In accordance with another broad aspect of the present invention, there is provided a tubing hanger and rotator assembly comprising: a tubing rotator body including: a lower flange connection configured to secure to a tubing head flange connection; a bore extending from an upper end of the tubing rotator body and through the lower flange connection, the bore defining a long axis; and a rotator gear communicating with the bore; a rotator bowl supported in the bore and in communication with the rotator gear and configured to be rotated about the long axis by the rotator gear; and a tubing hanger including: an outer hanger body supportable in the rotator bowl and configured to be rotated about the long axis with the rotator bowl; and a mandrel for connection to a tubing string, the mandrel supported in a main bore of the outer hanger body by J-lock mechanisms configured such that the mandrel is disengageable from the outer hanger body and lowerable through the outer hanger body into a tubing string tensioning position.

It is to be understood that other aspects of the present invention will become readily apparent to those skilled in the art from the following detailed description, wherein various embodiments of the invention are shown and described by way of illustration. As will be realized, the invention is capable of other and different embodiments and its several details are capable of modification in various other respects, all within the present invention. Furthermore, the various embodiments described may be combined, mutatis mutandis, with other embodiments described herein. Accordingly, the drawings and detailed description are to be regarded as illustrative in nature and not as restrictive.

BRIEF DESCRIPTION OF THE DRAWINGS

Referring to the drawings, several aspects of the present invention are illustrated by way of example, and not by way of limitation, in detail in the figures, wherein:

FIG. 10A-10F, sometimes collectively referred to as FIGS. 10, are views of an assembly for rotatably supporting a tubular string in a well for tensioning the tubing string.

FIG. 13A shows the tubing hanger aligned and ready to be inserted down, arrow A, into the tubing rotator, while the tubing rotator is in place mounted on the tubing head. FIG. 13B shows the tubing hanger installed in the tubing rotator bowl and held down.

DETAILED DESCRIPTION OF EMBODIMENTS

The detailed description set forth below in connection with the appended drawings is intended as a description of various embodiments of the present invention and is not intended to represent the only embodiments contemplated by the inventor. The detailed description includes specific details for providing a comprehensive understanding of the present invention. However, it will be apparent to those skilled in the art that the present invention may be practiced without these specific details.

Tubing Hanger with Safety and Well Control Options

Some tubing hangers present safety issues. For example, some tubing hangers cannot be attached though the service rig BOP when pulling the tubing in tension. The use of such tubing hangers require the service rig BOP to be removed and personnel to go under the rig floor to install the locking bolts. Installation of the locking bolts also requires pulling the outer hanger body up high enough to install the locking bolts, thus requiring additional tubing stretch and force that could be detrimental to the tubing or to the anchoring device or packer downhole.

Some tubing hangers with tensioning capabilities offer only limited well control options during tensioning. In particular, when pulling tension into the tubing string, the well may become opened to surface. This creates a potential hazard for workers on surface.

Other tubing hangers with tensioning capabilities can work with tubing rotators, but they are susceptible to failure.

Figure 1:
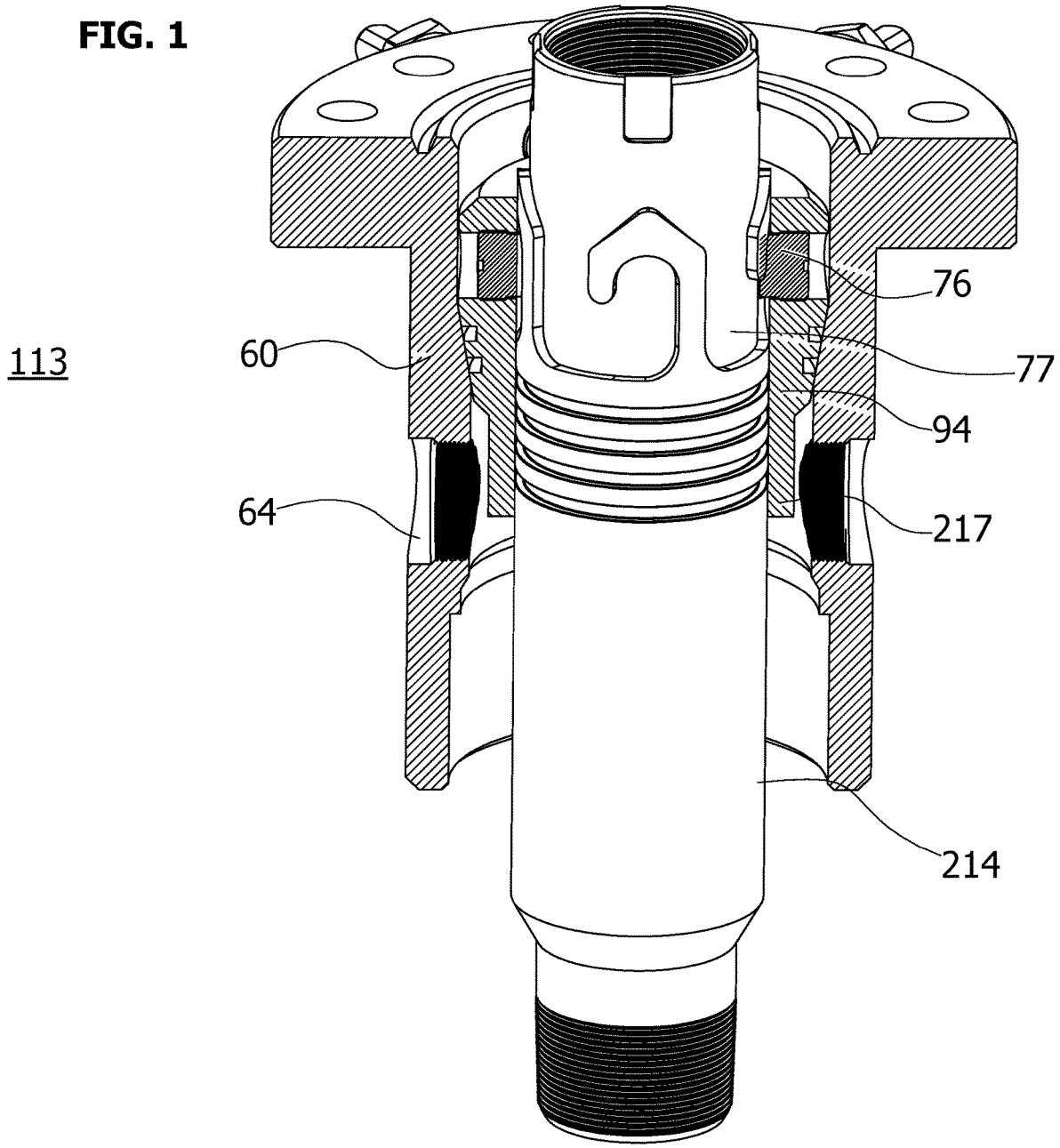
FIG. 1 is a side view, partially a cross-section, of an assembly for supporting a tubular string in the well for tensioning the tubing string.

FIG. 1 depicts one embodiment of a tubing hanger 94 in a wellhead assembly 113. Tubing hanger 94 is configured to support a tubing string and permits manipulation to tension the tubing string, such as to pull tension into the tubing string for actuation of an anchor or packer downhole.

Assembly 113 includes a tubing head 60 that includes at least one, and more commonly two, side ports 64 and is fluidly sealed to a wellbore casing.

Tubing head 60 is configured with an inner open area and a diameter constriction to support a tubing hanger. While there are other configurations with more abrupt shoulders, this illustrated tubing head has a generally frustoconical downwardly tapering inner surface. In particular, an inwardly tapering surface 61, sometimes called a bowl, is defined within the tubing head on which tubing hanger 94 can be supported. One or more lockdown screws 66 may be used to secure the tubing hanger 94 within the tubing head 60 and prevent upward movement of the tubing hanger in response to high fluid pressure from below.

Tubing hanger 94 includes a mandrel 214 and an outer hanger body 217 positioned concentrically about the mandrel. The outer hanger body is a diameter that can fit through the service rig BOP and the mandrel 214 is a diameter to fit through the rig tongs. These features allow the tubing hanger to be placed into the tubing head through the service rig BOP and the mandrel can be handled and torqued to the prescribed amount using the rig tongs. In particular, the rig tongs can apply the correct torque to secure the mandrel for manipulation. The tubing is prevented from rotation, by the back-up wrench of the tongs or alternatively by the rig slips, while the torque is applied.

Mandrel 214 includes a connection at its lower end such that, in use, the mandrel can be threadably connected to the tubing string. Threads 238 provided at the upper end of the mandrel 214 may be used for tensioning the tubing string, as explained subsequently.

Outer hanger body 217 encircles the mandrel and is configured with an outer diameter surface that is downwardly tapering such that a shoulder is defined, which is sized and shaped to rest on the tapered frustoconical surface 61 of the tubing head 60. One or more seals 33, such as annular elastomeric or annular wedge lock seals, are provided on the outer surface of hanger body 217 to create an annular seal between surface 61 of the tubing head and the hanger body. Outer hanger body 217 has a main bore that accommodates mandrel 214.

As such, the assembly includes outer hanger body 217 supported on the tubing head, and inner mandrel 214 within the bore of, and supported on, the outer hanger body and indirectly supported on a tubing head.

The outer hanger body and the mandrel 214 are releasably locked together by a J-lock mechanism discussed subsequently. Thus, when outer hanger body 217 is supported in tubing head 60, J-lock mechanism ensures that mandrel 214 can be supported within body 217. However, by manipulation of the mandrel about the J-lock mechanism, mandrel 214 can be moved axially relative to the hanger outer body. In particular, the outer hanger body 217 and the inner mandrel 214 are connected rotationally and axially by a plurality of, for example four, circumferentially spaced J-lock connections. Each J-lock connection includes a pin 76 that rides in a slot 77. Each slot 77 is, for example shaped like a J. The pins 76 for the J-connections are secured to the outer hanger body 217, while the corresponding J-slots 77 are machined on the outside of the inner mandrel 214. The pins 76 may be threaded to the outer hanger body 217, or may otherwise be secured thereto. The J-slots are actually defined by the sidewalls of the slots, where the slot shape in which the pin rides, is a recess compared to mandrel material that remains between the slots. While the system may be capable of operation with one pin 76 in one slot 77, generally there are a plurality of pin/slot pairs spaced about the circumference of the tubing hanger.

Using the J-lock mechanisms, a controlled amount of rotation applied to mandrel 214 may be used reliably to move the J-slots relative to the pins.

As disclosed herein, the J-lock pins 76 extend radially inward from and are fixed to the outer hanger body 217, and the corresponding J-slots 77 are provided in the inner mandrel 214. Pins 76 are positioned above seals 33, so that the J-slot mechanism is positioned in the annulus sealed area.

This means that the pins are isolated by seals 33 from the wellbore pressure. As such, pins 76 can extend through the radial thickness of the outer hanger body.

In this embodiment, J-slots 77 are formed with their openings 77' facing up and the hanging location 77*a* in each slot is downwardly opening and at the terminal end of the slot. As such, mandrel 214 can be unhooked from the pins 76, by pulling up on the mandrel (shown in FIG. 2) and rotating slightly. Then, the mandrel can be moved down in the well to disengage the slots from the pins. The mandrel can then be moved down a distance below the tubing head. This operation is useful for manipulation of an anchor/packer in communication with the tubing string below the mandrel 214. Pulling the mandrel back to engage it onto the pins of the outer hanger body provides a certain amount of tension into the tubing string. Specifically, when the mandrel is moved back up, the slots 77 can be aligned with the pins and the mandrel can be pulled up, rotated and set down to hook the terminal ends of the J-slots 77 onto the pins 76 (shown in FIG. 1). The mandrel cannot be pulled up entirely through the outer hanger body due to the pins and slots 77, but the pins can be exited from slots by moving the mandrel down relative to the outer hanger body.

The mandrel is moved down in the well to a depth sufficient to manipulate the packer/anchor and adjust the tension of the tubing string connected thereto. Such movement can move the J-slots down significantly in the well, for example, below, ports 64 and below the tapering frustoconical outer surface of outer hanger body 217. The actual depth varies but typically, the string is moved 1 to 20 feet, for example 3 to 5 feet for 2⅞ tubing, down into the well before being pulled up and tensioned.

Annular deformable seals 216, such as o-rings or other annular elastomeric seals, are in glands 216 that encircle and are carried on mandrel 214 below J-slots 77. These seals seal against the main bore of outer hanger body 217 and prevent well fluids from migrating up between the mandrel and outer hanger body 217. Placement of the seals on the mandrel, as opposed to within the outer hanger body, offers a number of benefits including ease of access for placement and repair and protection against damage by structures. For example, if the seals are in the ID of the outer hanger body, the seals may be damaged by structures, such as the J-slots of the mandrel, as the mandrel is moved up and down during string tensioning. The seals, being in glands 216 on the OD of the mandrel 214 below J-slots 77, never come into contact with or have to pass over the pins.

Figure 2:
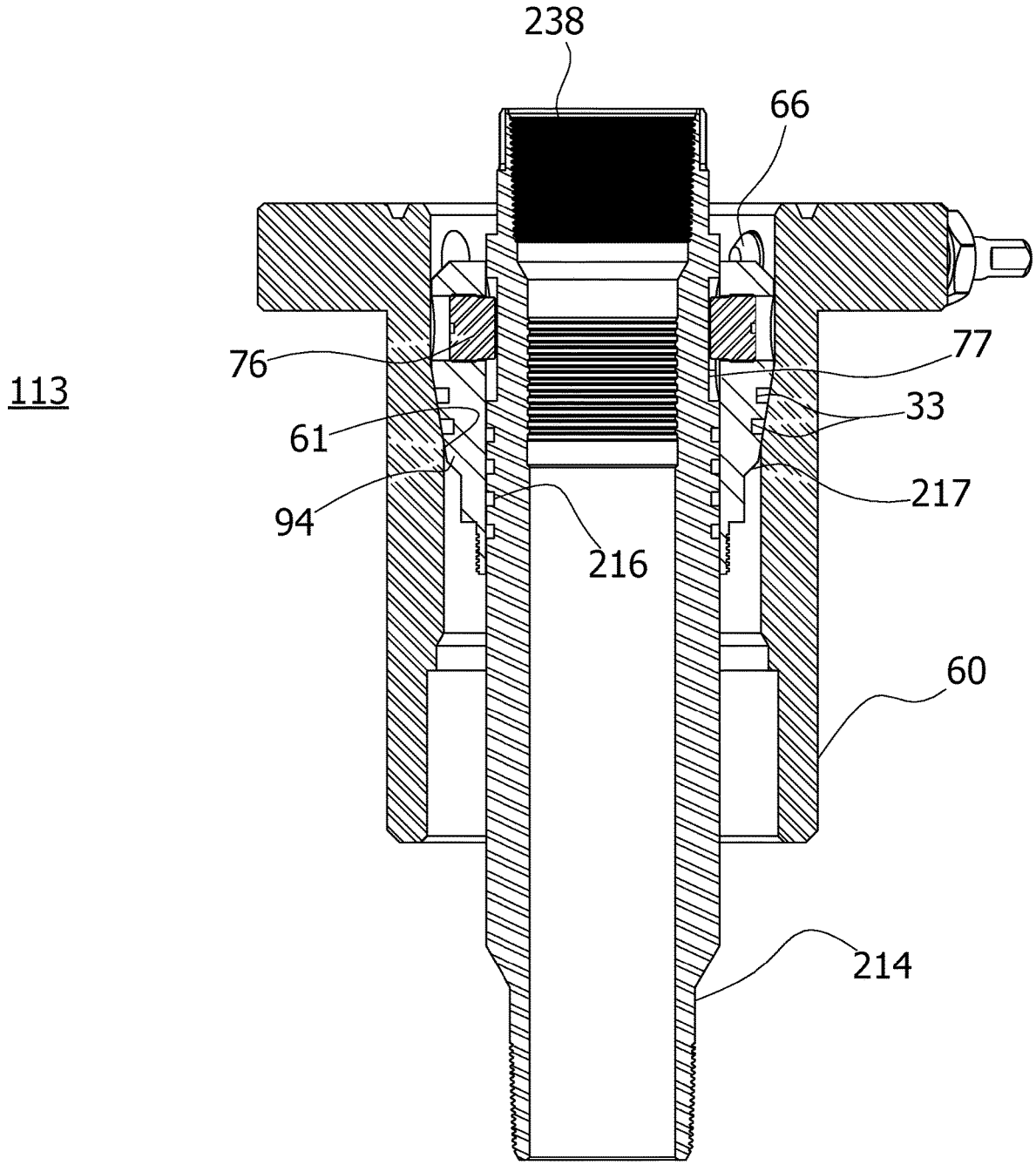
FIG. 2 is a view, entirely in section, of the components of FIG. 1.
Figure 3:
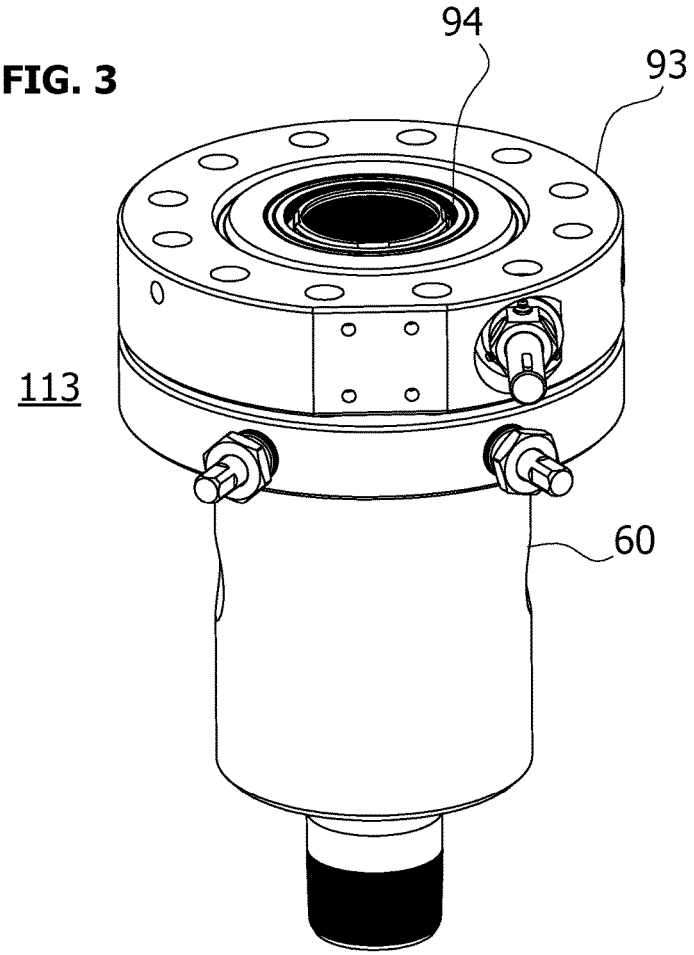
FIG. 3 is an isometric view of an assembly for rotatably supporting a tubular string in a well for tensioning the tubing string.
Figure 4:
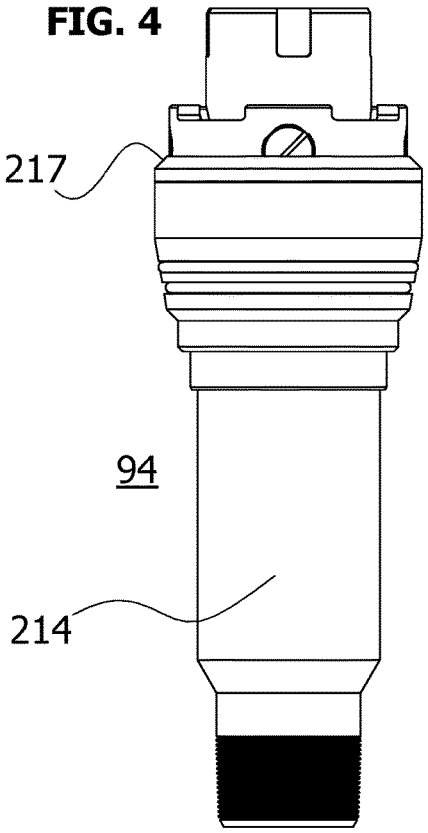
FIG. 4 is a side view of the tubing hanger from the assembly of FIG. 3.

The embodiment of FIGS. 1 and 2 is a static (non-rotating) tubing hanger to replace conventional hangers with the ability to pull tension as might be required, for example with a packer or anchor, with better well control and safety. It is to be understood, however, that the technology can be applied as well to a rotary moveable tubing hanger. With reference to FIGS. 3-7, for example, there is illustrated an assembly 113 with another embodiment of a tubing hanger 94 that is configured to receive torque and allow tubing rotation from a tubing rotator 93.

In such an embodiment, the tubing hanger 94 still includes a mandrel 214 and an outer hanger body 217 positioned concentrically about the mandrel.

The mandrel can be as described above with J-slots 77.

The outer hanger body 217, however, includes parts that permit the mandrel to receive and transmit a rotary drive from a tubing rotator, while the pins 76 and J-slots 77 are engaged. For example, outer hanger body 217 can include a rotatable portion 71, a support portion 73 and a thrust bearing 74 between the support portion and the rotatable portion.

Support portion 73 and rotatable portion 71 are each annular and together encircle the mandrel.

Rotatable portion 71 has secured thereto pins 76 for the J-locked mechanisms. The inner mandrel 214 can be locked, via its slots 77, onto the pins 76 or the inner mandrel can be unhooked from the pins 76 and moved axially inside the rotatable portion 71. As noted above, the axial movement of the mandrel within the outer hanger body including, rotatable portion 71, allows the setup of the tubing anchor and the subsequent stretching of the tubing string. After adjustment of the string, the mandrel can be engaged onto the pins of the rotatable portion 71, thereby transmitting the hanging load to outer hanger body and the tubing head.

The embodiment of FIGS. 3-7 operates with a tubing rotator 93, which herein is positioned on and is connected by bolts to the tubing head.

When mandrel 214 is driven to rotate, rotatable portion 71 rotates with the mandrel.

Support portion 73 includes the shoulder and frustoconically tapering outer surface that is retained, non-rotatably on the tubing head inner surface. Thrust bearing 74 is provided to facilitate rotation of rotatable portion 71 relative to support portion 73.

Thus, in summary, rotatable portion 71 is a part of outer hanger body 217. Thus, when rotatable portion 71 is supported in the tubing head, it is axially fixed relative to the tubing head 60. The inner mandrel can be supported on the rotatable portion, via pins/slots, and when supported, the mandrel and the rotatable portion 71 rotate together. The inner mandrel 214 is threaded directly to the tubing string and can travel axially a limited distance, as explained subsequently, relative to the rotatable portion.

Because the pins 76 are on rotatable portion 71, the pins can rotate with the rotatable portion to facilitate reentry to the slots 77 of the mandrel. Thus, while in FIG. 1 above, the mandrel 214 has to be moved to move the slots relative to the pins 76, in this embodiment, applied forces against the pins can cause the rotatable portion 71 to rotate. In particular, abutment of the edges of the slot against the pins, can cause the rotatable portion 71 to self align the pins thereon with the slot opening 77' and the path into and out of the hanging location in the slot.

There is an annular seal between mandrel 214 and outer hanger body 217. In particular, the seal is positioned on mandrel 214 in an area of the tubing hanger that is below J-pins 76 and J-slots 77.

The tubing hanger of FIGS. 3-7 is very durable. In particular, each of (i) the construction of outer hanger body and (ii) the interaction between the rotator and the tubing hanger, independently or in combination, provide a durable tubing hanger and assembly.

With respect to the construction of the outer hanger body, bearing 74 is enclosed between support portion 73 and the rotatable portion and is not exposed in the main, center bore of the outer hanger body. Therefore, bearing 74 is not exposed to wear and damage of the mandrel and the string tubulars being moved therepast. In particular, a sleeve portion 71' of the rotatable portion extends down through a bore in the support portion. The inner diameter across the bore of sleeve portion 71' defines the main bore of the outer hanger body through which mandrel 214 extends. The bearing is positioned between the support portion and the rotatable portion and behind, or in other words radially outwardly of, sleeve portion 71'. Seals 78 are positioned between the support portion and sleeve portion 71' below bearing 74 so that well fluids cannot migrate into the bearing.

The back side of bearing 74 is also protected against contamination by a wall of support portion 73 that extends behind it. Seals 78 below and seals 78' above protect the bearing against fluid infiltration and debris.

In addition, bearing 74 is closer to the upper end of the outer hanger body 217 than the lower end. Thus, bearing 74 is in a thicker and therefore more rugged area of the outer hanger body.

In addition, the construction of the outer hanger body provides durable interaction between the support portion 73 and the rotatable portion 71 against axial separation. In particular, a cap 73' is secured to the upper end of support portion 73 and has an inwardly extending return extends over an upper-facing shoulder on the outer surface of rotatable portion 71. The cap can be an annular ring that threads to support portion 73 and the inwardly extending return may be an annular structure that encircles the rotatable portion or the mandrel depending on the location of it. Rotatable portion 73 can rotate relative to support portion 73 and cap 73', but the inwardly extending portion of the cap 73' acts against the upwardly facing shoulder of rotatable portion 71, to retain the rotatable portion axially on top of the bearing and support portion 73. In particular, cap 73' resists axial lifting of the rotatable portion relative to the support portion if an upward force is applied to the rotatable portion, for example through the mandrel. Because the rotatable portion is normally biased down by the string weight or tension, the cap rarely has axial forces applied to it, thereby reducing wear and maintenance. If desired, as shown in the illustrated embodiment, cap 73' may be positioned overlapping or below the pins 76, such that they can be accessed.

There is no portion of rotatable portion that projects out above the cap 73', so the rotatable portion does not bear down on the cap. However, cap 73' may be positioned such that it is immediately below the hold down bolts 66. If there is any upward force on the tubing hanger, the cap stops against hold down bolts 66. Thus, the hold down bolts act on a static, non-rotatable component, rather than a rotatable component of the tubing hanger.

Figure 5:
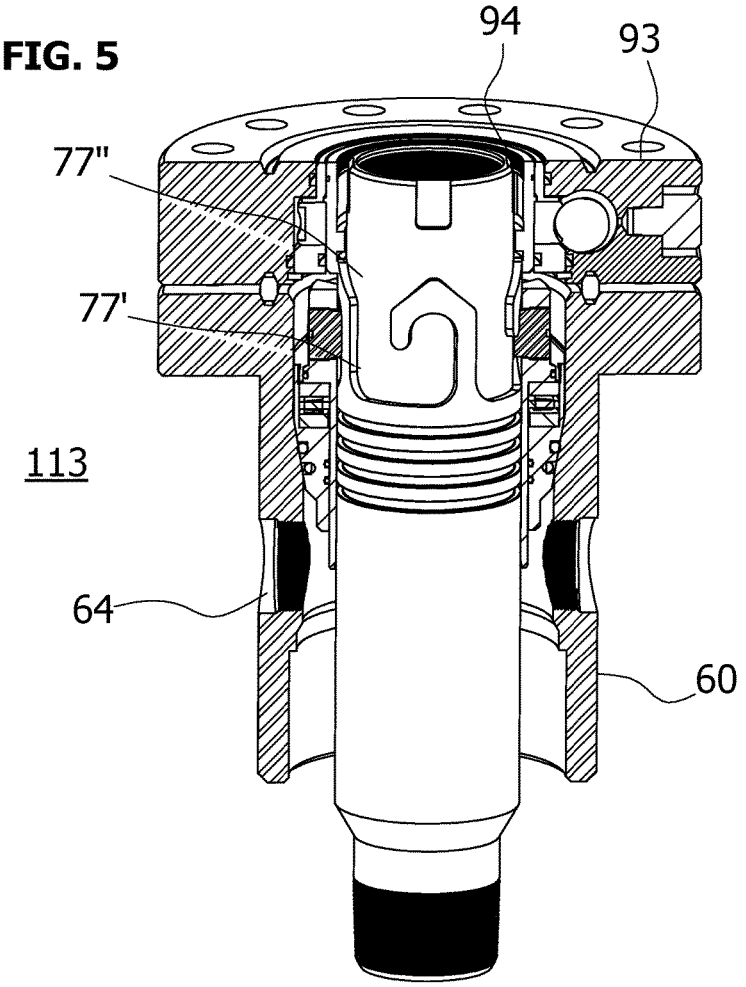
FIG. 5 is a side view, partially in section, of the assembly of FIG. 3.
Figure 7:
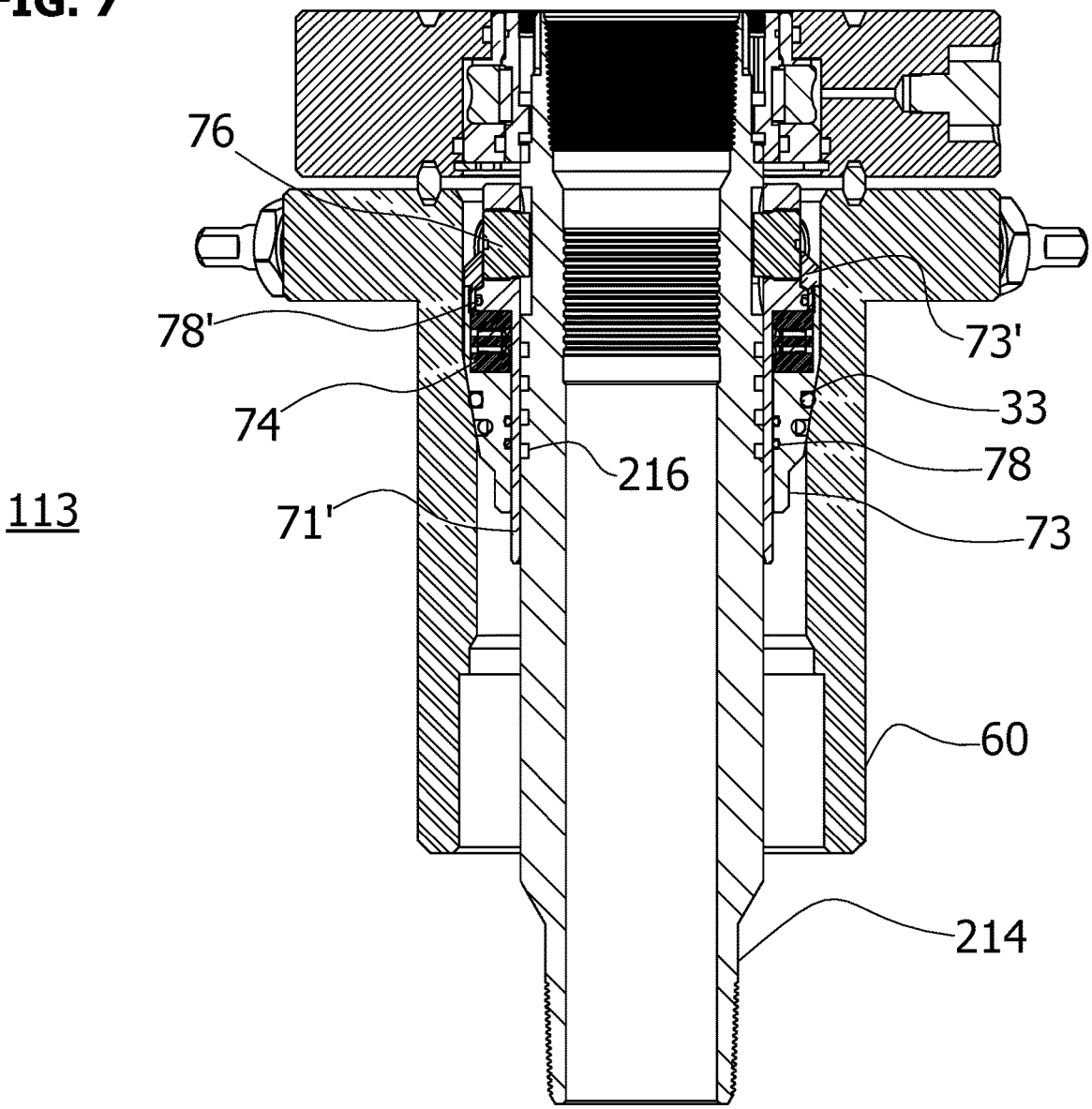
FIG. 7 is a view, entirely in section, of the components of FIG. 5.

With respect to the interaction between the rotator and the tubing hanger, FIGS. 5 and 7 illustrate the connection between the tubing rotator 93 and the tubing hanger 94. Tubing rotator 93 directly applies torque to the mandrel 214. Since mandrel 214 is directly rotated, stresses at the J-lock connections are reduced. In particular, the pins 76 mostly handle vertical load and are protected from the major force of rotation. The pins 76 and rotatable portion 71 need only accommodate the rotation of mandrel 214 rather than transmitting torque drive to the mandrel.

Figure 6:
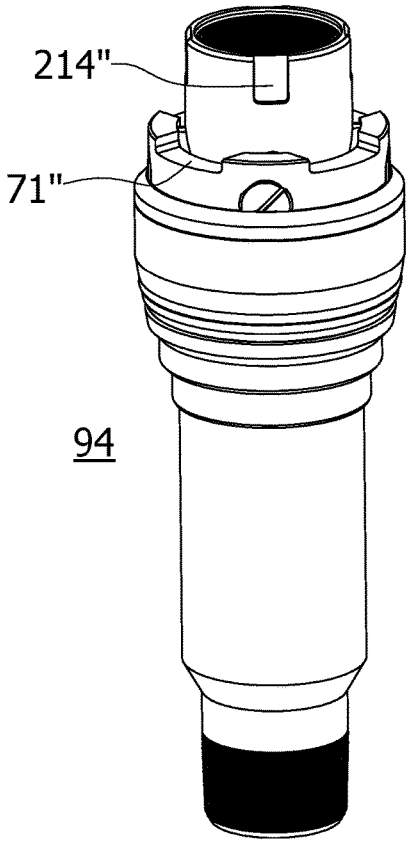
FIG. 6 is a side view of the tubing hanger from the assembly of FIG. 3, with the mandrel pulled up.

More particularly, the upper end of the mandrel has a faceted, for example, splined, toothed, detented or hexagonal, outer surface 214", that mates with a driven ring on the tubing rotator. Those skilled in the art appreciate that other configurations of non-cylindrical surfaces may be used for rotatably connecting these components, while allowing the rotator 93 including the rotator driven ring to be lifted vertically to disengage from the tubing head 60. FIGS. 5 and 6 show the faceted outer surface at the upper end of the mandrel 214, which receives torque from the rotator 93.

While some previous tubing hangers with tensioning capabilities provide limited well control options during tensioning, the present embodiment of hanger body 217 can be suspended from a handling sub and introduced into the tubing head through the service rig BOP, thus providing well control. In particular, most prior systems cannot be tensioned with the service rig BOP in place. Removing the service rig BOP and then extending the mandrel below the outer hanger body means that well fluids can then escape between the tubing and the outer hanger body. Water is typically added to suppress the well pressure but gas can percolate through the water and break into the space between the tubing and outer hanger body, thus creating the possibility of a well blowout. The present invention allows the service rig BOP to remain connected to the wellhead and the mandrel to be manipulated by a handling joint extending through. If gas or fluid starts to escape, the service rig BOP can be closed around the handling joint to prevent pressurized gases and fluids from escaping. Then water can be added through the annulus to "kill" the well before any further manipulation is attempted.

If a further option for well control is of interest, the present tubing hanger may be configured to include a length of the outer hanger body's bore below the pins, against which the seals in glands 216 can remain set when lowering the mandrel. For example, as illustrated in FIG. 7, sleeve portion 71' can be extended down to create a cylindrical surface against which the mandrel seals can remain sealed even when the mandrel is moved down.

Figure 8:
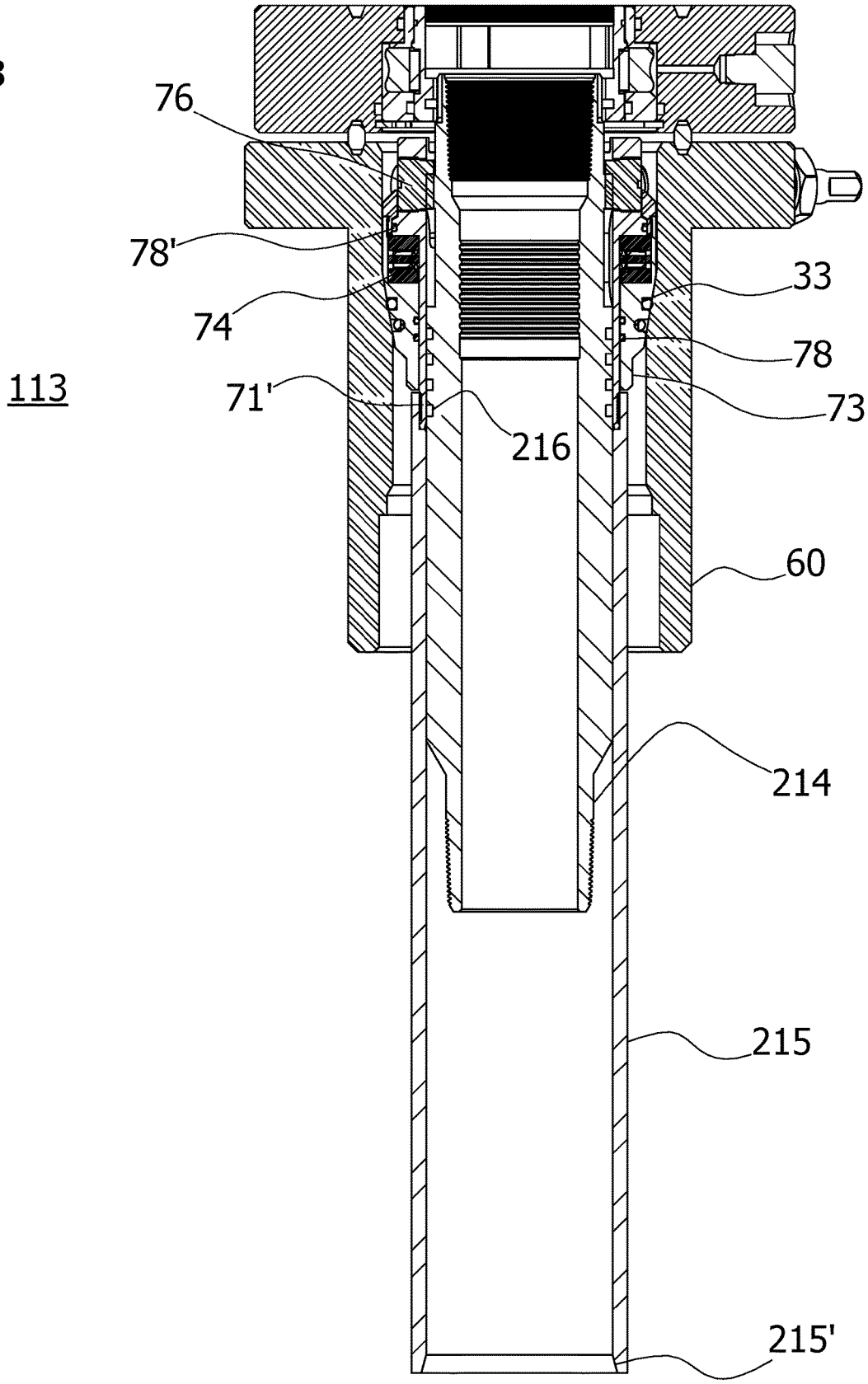
FIG. 8 is a view, entirely in section, of another assembly for rotatably supporting a tubular string in a well for tensioning the tubing string.
Figures 9A, 9B:
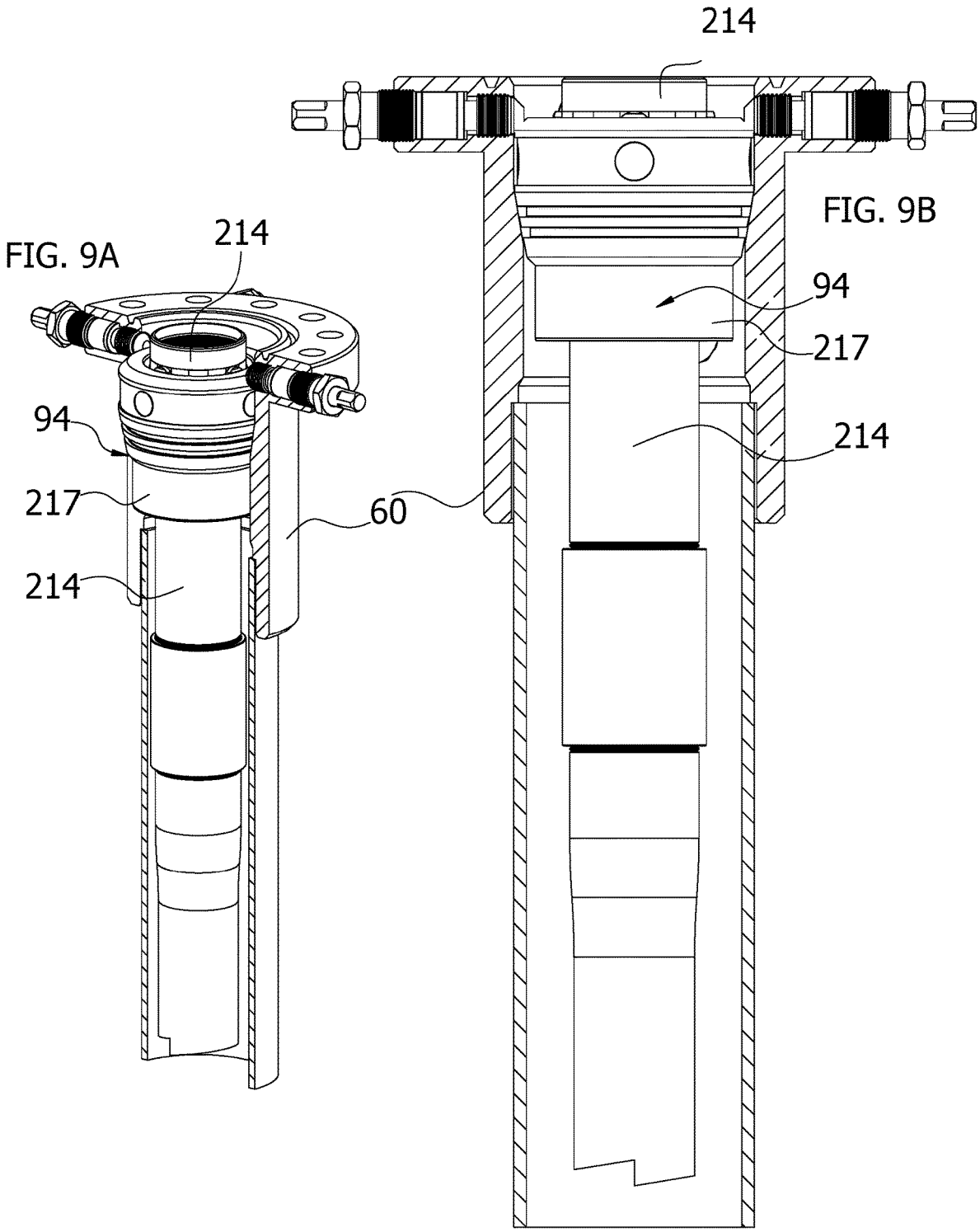
FIG. 9A-9F, sometimes collectively referred to as FIG. 9, are views of an assembly for rotatably supporting a tubular string in a well for tensioning the tubing string.
Figure 9C:
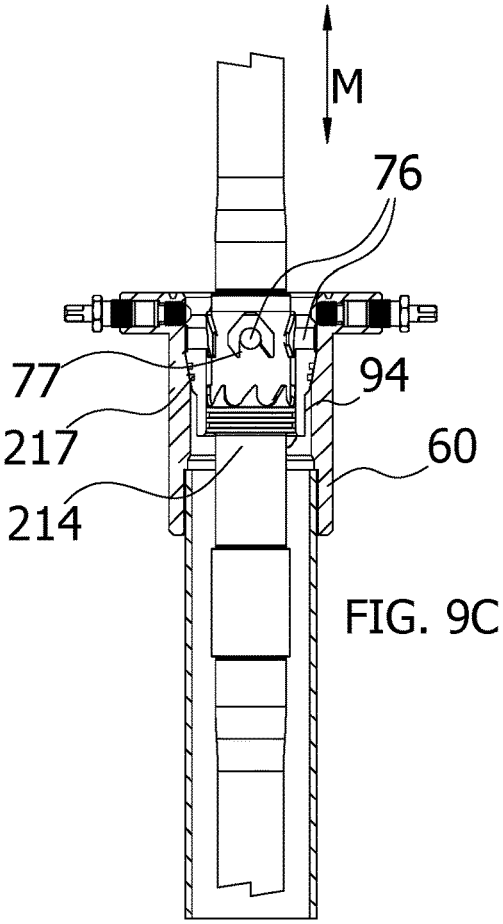
Figure 9D:
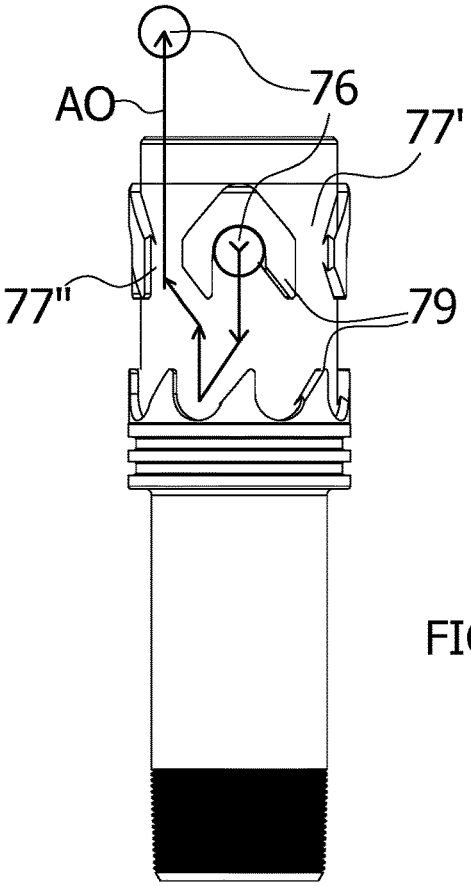
Figure 9E:
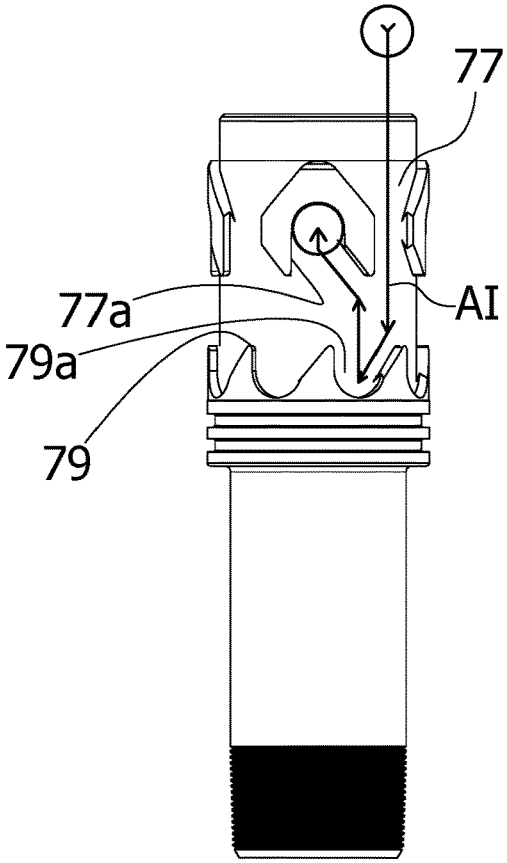
Figure 9F:
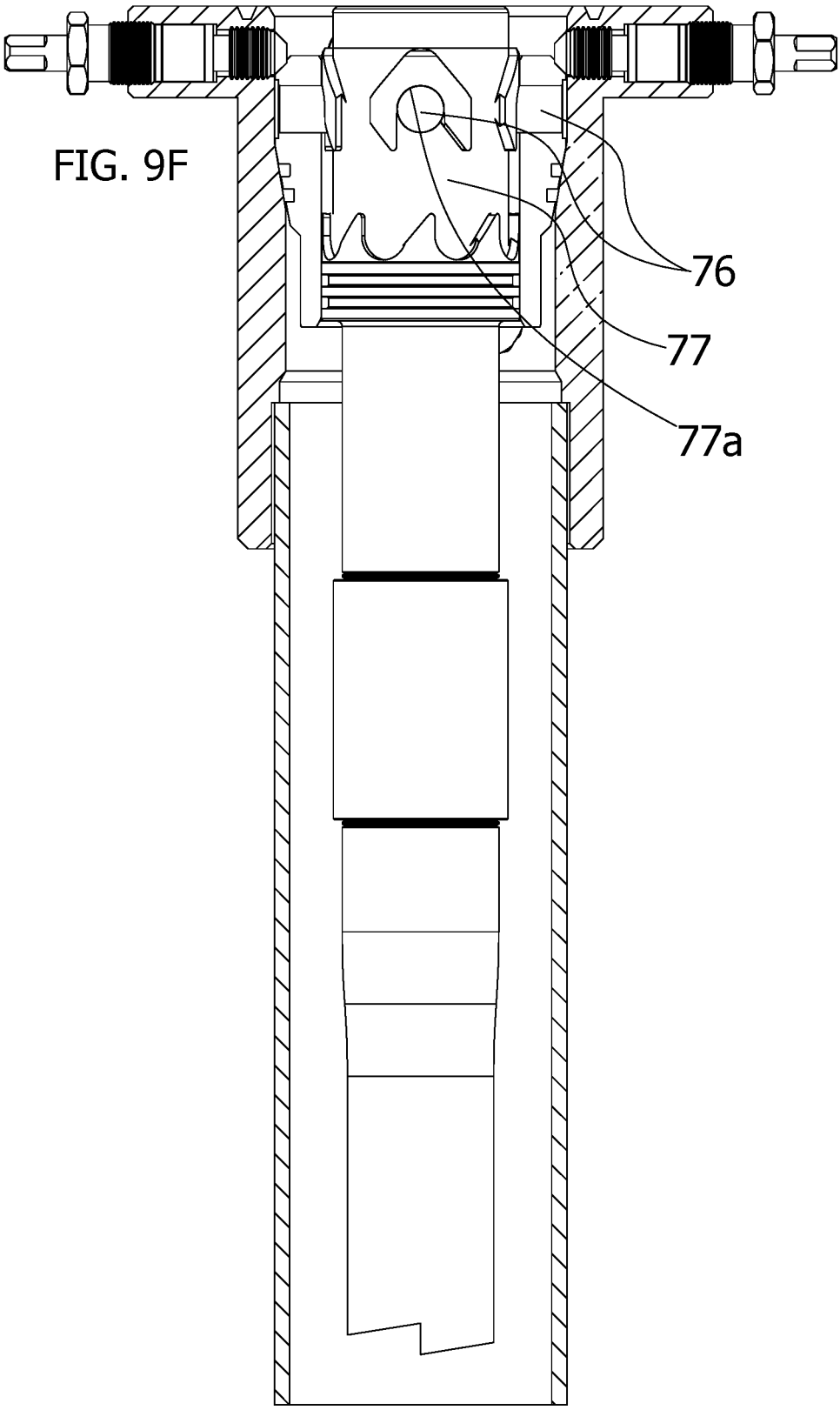

With reference to FIG. 8, if a further option for well control is of interest, the present tubing hanger may include a lower extension sleeve 215 that maintains a seal in an area of the tubing hanger that is well below J-pins 76 and J-slots 77, even when the mandrel is moved down significantly during tensioning. In such an embodiment, outer hanger body 217 may have attached a lower extension sleeve 215 that effectively elongates its main bore. In this illustrated embodiment, lower extension sleeve 215 permits the seal between the outer hanger body and the mandrel to remain set even when the mandrel is lowered for tensioning. The lower extension sleeve 215 may be integral with the outer hanger body or coupled directly or indirectly thereto. In this illustrated embodiment, sleeve 215 is threaded to the lower end of the outer hanger body below the frustoconically shaped portion of the outer hanger body. Regardless, there is no leak path between the lower extension sleeve and the outer hanger body. Lower extension sleeve 215 extends down at least the length of the frustoconically tapering outer surface of outer hanger body 217 and in one embodiment the sleeve, for example, may be 1 to 20 feet long and possibly 3 to 10 feet below the tapering portion of the outer surface of outer hanger body 30. In one embodiment, the distance between pins 76 and the lowermost end 215' of sleeve 215 is greater than the length of mandrel 214 between J-slots 77 and the lowermost end of the mandrel.

Seals for sealing between sleeve 215 and mandrel 214 may be located on a lower end of the lower extension sleeve or on the mandrel. For example, a deformable seal member can be installed in the inner diameter of lower extension sleeve 215 near its lowermost end 215', but this may require a thicker wall, so it is not preferred. In the illustrated embodiment, for example, the one or more annular deformable seals in glands 216 are carried on mandrel 214 below J-slots 77. These seals 216 remain sealed against the main bore or lower extension sleeve 215 of outer hanger body 217 regardless of where the mandrel is axially relative to the outer hanger body. In other words, the seals in glands 216 remain set against either main bore or the inner diameter of lower extension sleeve 215 whether the J-slots 77 are (i) hooked on pins 76, (ii) pulled up relative to pins 76 or (iii) moved further down well below pins 76.

In such an embodiment, the inner diameter of lower extension sleeve 215 is substantially consistent along its length and has a similar inner diameter dimension as main bore of the outer hanger body below pins 76. The inner diameter of lower extension sleeve 215 may be polished to facilitate sealing of the seals 216 there against. The lowermost end 215' of sleeve 215 may be chamfered on its inner circumference to avoid catching on the connections between mandrel 214 and the tubing string and to facilitate re-entry of the mandrel seals 216, if they are moved downwardly out of the extension sleeve.

An annular space remains between lower extension sleeve 215 and tubing head 60 so that fluid can continue to flow up the outer surface of sleeve 215 to the ports 64 or so water can be introduced through the ports to "kill" the well. Since lower extension sleeve 215 only serves to maintain a seal with mandrel, it can be very thin walled.

The tubing hanger of FIG. 8 has a rotatable construction for use with a tubing rotator. However, it is to be understood that an extension sleeve could also be employed with a static tubing hanger such as that shown in FIG. 2.

Sleeve 215 can extend down from either the support portion or the rotatable portion. In the illustrated embodiment, sleeve 215 is threadably connected to rotatable portion 71. As such, the entire length of sleeve rotates with rotatable portion 71 and mandrel 214. This reduces wear of seals 216, as they are moved only axially relative to the sleeve.

All the tubing installation and tensioning is done before the tubing rotator is installed. When servicing the well, the tubing rotator is removed and then the service rig BOP is attached to the tubing head. Because the rotator engages the outer surface of the mandrel, the upper end of the mandrel remains open for access to the mandrel's inner bore and, therethrough, to the string inner diameter, even when the rotator is in place and functioning.

Using the surface equipment disclosed herein, the tubing string attached to the lower end of the mandrel 214 may be manipulated by axial pull or set-down weight, to set an anchor or packer at the lower end of the tubing string. Using the surface equipment of FIGS. 3-7, the tubing string and mandrel 214 may further be rotated by a tubing rotator.

To install the tubing hanger, after the tubing is run in, the tubing string is supported on the rig slips, then the mandrel is connected to the last joint of the string. The mandrel is pulled up to the rig tongs so it can be torqued with the rig tongs to specification. Then the tubing is supported by the rig slips again. The handling joint is then removed from the mandrel and the outer hanger body 217 is then put onto the mandrel and hooked onto the hanger outer body 217 via the J-lock connections 76, 77. The handling sub is then reconnected to the mandrel and lifts the mandrel, outer hanger body and tubing string to release the rig slips. The assembly is then lowered through the rig BOP until the outer hanger body is seated into the tubing head. The tubing head lag bolts 66 are then installed to hold the tubing hanger down in place. The handling joint is the raised and rotated to disengage the J-lock connection and the tubing string is lowered a prescribed amount that is calculated to provide the required amount of tension to the tubing string. The anchor or packer is then set. Pulling the tubing string back up and latching the mandrel into the J-lock locks in the tension and that tension can be verified by reading the string weight from the rig's weight indicator.

Once tensioned at the desired level, the rotator 93 is activated to rotate the mandrel and, therethrough, the tensioned tubing string.

It should be apparent that the present invention allows for tubing tensioning after the tubing string is anchored, and the tensioned tubing can then be rotated by a tubing rotator. In a reverse operation, tension may be released to remove the anchor. Since the tubing hanger is supported on the tubing head rather than the rotator, the rotator may be replaced without pulling the tubing string. The present invention also allows full access to the tubing string, and allows the tubing string to be set with various types of anchors, which requires push/pull or rotational operations of the tubing string.

When a tubing rotator is employed, it is installed over the upper end of the mandrel and the mandrel meshes with the driven ring of the tubing rotator. The torque generated by the tubing rotator is applied to the mandrel. The rotatable portion 73 supports that rotation.

Figure 10A:
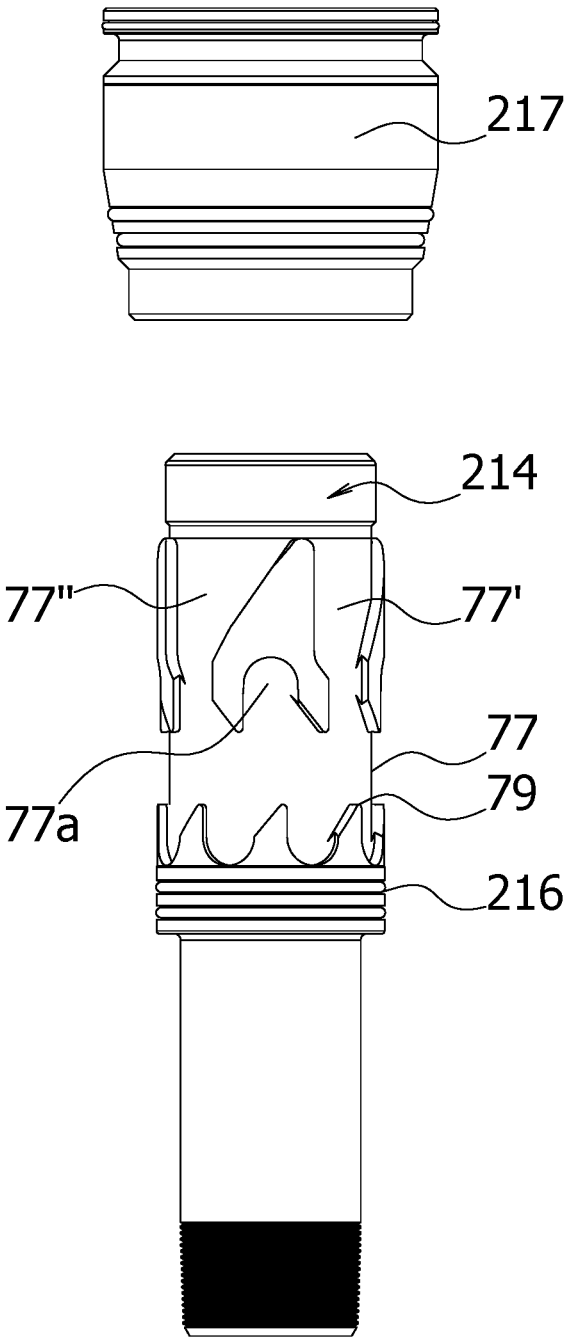
Figure 10F:
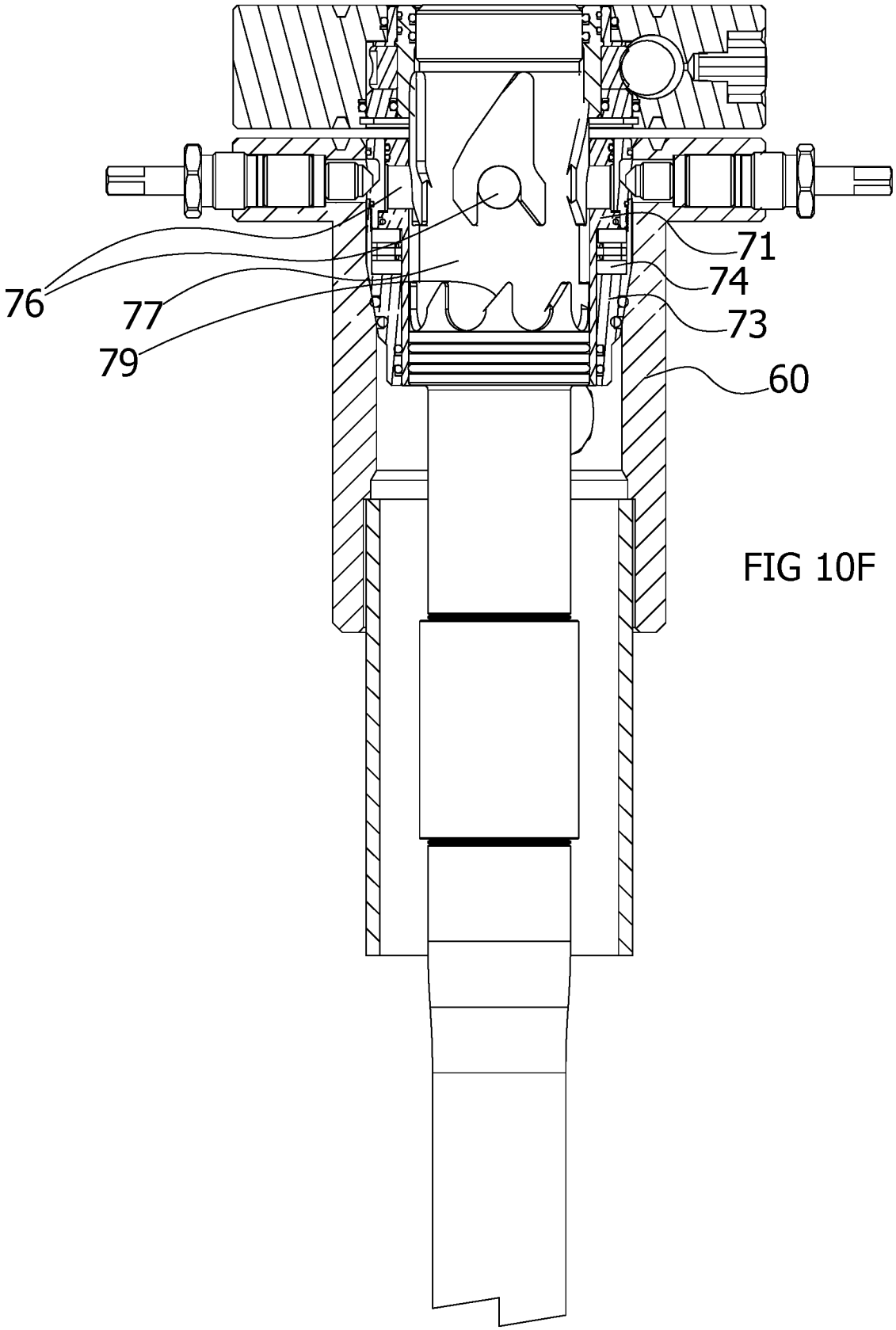
Figure 11:
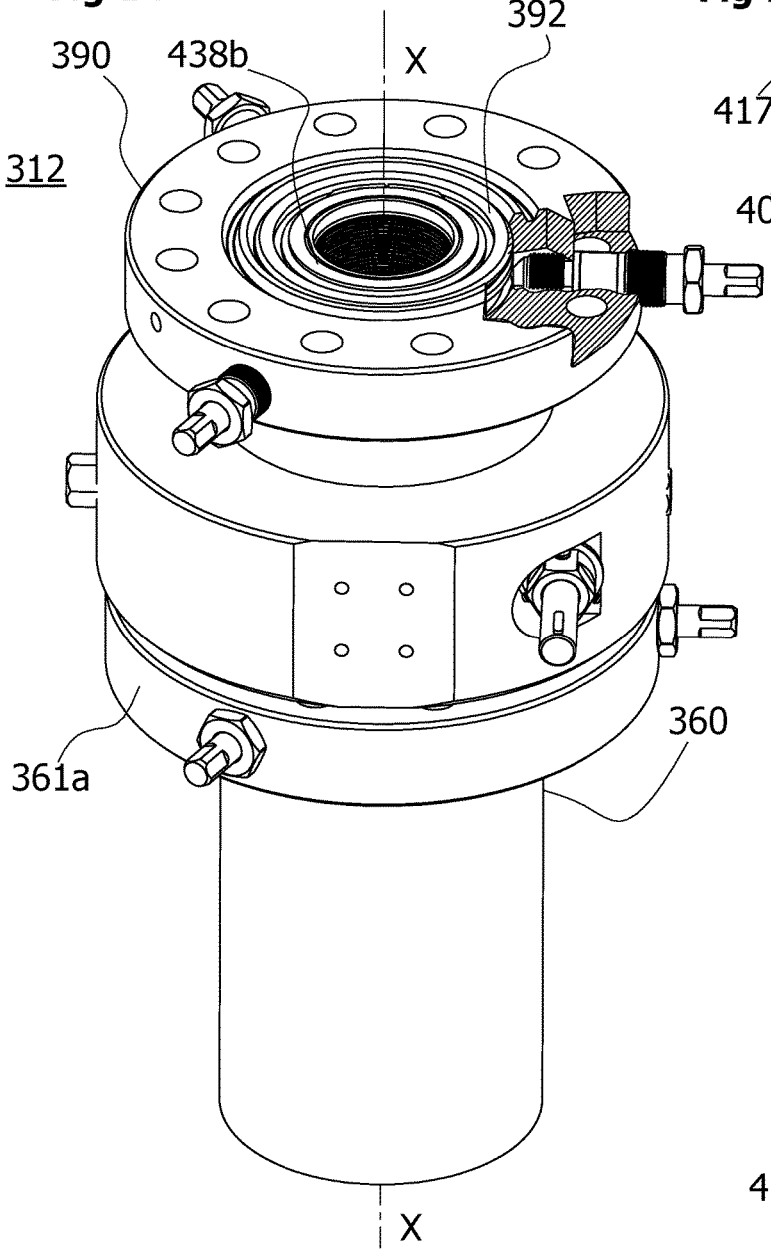
FIG. 11 is an isometric view of an assembly installed on a wellhead flange, the assembly for rotatably supporting a tubing string in the well and operable for tensioning the tubing string.

Another embodiment of the invention is illustrated in FIGS. 9 and 10. As with the above embodiments, the tubing hanger 94 is supported in the tubing head 60 and includes an outer hanger body 217 and an inner mandrel 214. The outer hanger body and the inner mandrel are configured with pins 76 and slots 77, respectively, that permit an operator to pull up the inner mandrel relative to the outer hanger body, then drop down to move the hanger inner mandrel and all attachments below further into the well. Then, the operator can pull the mandrel back up to pull tension and re-engage the mandrel on the outer hanger body. This can all be done through the BOP.

The mandrel is moved to hook and unhook the mandrel from the outer hanger body. Specifically, movement, arrow M, of the mandrel while the hanger outer body remains in place on the wellhead, reliably moves the J-slots relative to the pins. In this embodiment, the J-slots are configured, for example, shaped with ramped surfaces, to facilitate insertion and removal of the mandrel relative to the pins 76. In addition, the J-slot 77 has an entry 77' opening separate from an exit opening 77" and a hanging location **77*a* (where slot is hung on a pin) is accessible from below and positioned between the openings 77', 77". The J-slot has a sidewall defining the slot path between opening 77' and position 77*a* that is ramped toward position 77*a* and an exit sidewall defining the slot path between position 77*a* and exit opening 77" that is ramped toward exit opening 77"**.

In addition, there is a ratcheting ring 79 that forms the bottom limit of the J-slot. Ratcheting ring 79 drives rotation of the parts for alignment of the pins and the J-slot. Ratcheting ring 79 includes a plurality of notches **79*a* between sidewalls. Each notch 79*a* has one ramped sidewall that is angled away from its highest point towards the depth of the notch. The ratcheting ring notches are positioned on the mandrel so that that the ramped side wall of one notch is axially below and aligned with the entry opening 77' and so that that the ramped side wall of a second notch is axially below and aligned with hanging location 77*a* in slot. Arrows AI in FIG. 9E and arrows AI' and AI" in FIG. 10E show the path of the movement of a pin 76 into slot 77, through opening 77' and into location 77*a*. The path of the movement of a pin 76 out of location 77*a* and out through opening 77" is shown by arrows AO in FIG. 9D and arrows AO', AO" in FIG. 10**C.

The embodiment of FIG. 9 is a static version where the hanger is not configured to accommodate tubing rotation. Rotation, for alignment of the slots with the pins, occurs through the mandrel.

In the embodiment of FIG. 10, the tubing hanger is able to accommodate rotation of the inner mandrel when string weight is supported, as driven by a tubing rotator. As such, the tubing hanger includes an outer hanger body with a thrust bearing 74 between an upper rotatable portion 71 and a support portion 73. The pins 76 are on the rotatable portion 71. The pins can, therefore, accept an applied force to rotate the rotatable portion, as permitted by the thrust bearing.

Using FIG. 10 as an example, the action of raising and lowering the mandrel 214 allows the rotatable portion 71 to rotate so that the pins 76 can follow the path of the J-slot 77.

1. When the operator wants to adjust tension in the string, the operator first engages the upper end of mandrel 214 and pulls up, this causes the ratchet ring 79 to hit against the pins 76 and this causes the pins to receive force to spin the rotatable portion 71 by a small turn (1/16th of a complete 360 degree turn). This is illustrated by arrows AO' as mandrel is moved relative to pin from the pin's starting, hung position **76*hp*, as location 77*a* of the slot is hung on its pin. The interaction between the pins and the ratchet ring 79, specifically the ramped right sidewall shape of the ratchet ring notches 79*a* and the location of that right sidewall below location 77***a*, forces the rotatable portion to spin in the same direction each time mandrel is pulled axially up out of its hung position.

2. When the operator lowers the string, the pins come into contact with ramped, exit side wall of slot and the pins and rotatable portion 71 turns 1/16th of a turn again allowing the pins to freely leave the path through exit opening 77", arrows AO". Thereafter, the pins in their exit position 76*e* are free of the mandrel and the mandrel and its attached string can be lowered into the well.

3. The operator pulls sets the anchor and pulls back up on the mandrel 214 to pull tension into the string. When the mandrel J-slots reach the pins, the rotatable portion 71 is spun by abutment of the slot edges against the pins. This allows the pins to line up with slot opening 77' and pins are forced from their exit position 76*e* to find their way into the J-slot path, arrows AI'.

4. Once in the path and the mandrel is pulled all the way up, the pin assembly spins 1/16th of a turn. In particular, when the mandrel is pulled all the way up, the ratchet ring 79 hits against the pins 76 and this causes the pins to receive force to spin the rotatable portion 71 by a small turn (1/16th of a complete 360 degree turn). This is illustrated by arrows AI' as mandrel is moved relative to pin, the pin effectively is repositioned from location 76*e* to a position against ratchet ring 79. The interaction between the pins and the ratchet ring 79, specifically the ramped right sidewall shape of the ratchet ring notches 79*a* and the location of that right sidewall below entry opening 77', forces the rotatable portion to spin the same degree and in the same direction each time mandrel is pulled axially up.

5. When the mandrel 214 is lowered back down, arrows AI", the pins and rotatable portion 71, spin 1/16th of a turn again locating the pins in the hanging position 76*hp*.

Once the mandrel is positioned with the location 77*a* of slots 77 hooked on the pins (i.e. once the pins are in the hanging position 76*hp*), the tubing hanger, specifically the interlock of pins 76 and slots 77, can accommodate the weight of the string and any tension pulled therein. The interlock of pins 76 in slots 77 also allow for the transmission of torque to allow the tubing to be rotated with a tubing rotator.

The illustrated embodiment if FIG. 10 is a typical A style tubing hanger that is rotated using an E Style rotator. Other embodiments can rotate and hang directly in the rotator head.

Tubing Hanger with Integrated Rotator

The following describes another tubing hanger that employs a J-lock mechanism. The following tubing hanger operates with an integrated rotator. The two embodiments of tubing hanger with safety and well control options and this tubing hanger with integrated rotator can be employed independently or can have features shared therebetween, if desired.

FIGS. 11-16 depict a tubing hanger 392 and tubing rotator 390 assembly in a wellhead installation 312. Installation 312 includes a wellhead support on or coupled to the upper, surface end of a wellbore casing. The wellhead support may be a threaded arrangement or flange. In the illustrated embodiment, the wellhead support is the flange on a tubing head 360. The tubing head includes a flange 361*a* at its upper end and at least one, and more commonly two, side ports and is fluidly sealed below to the wellbore casing.

While there are other configurations, a tubing head generally has an upper flange 361*a* adapted to support a flange connection and an open inner diameter that opens on the flange and is downwardly narrowing either by stepping or by frustoconical tapering. In this illustration, tubing head 360 has an inner surface 361*b*, sometimes called a bowl, that frustoconically tapers.

The integrated tubing hanger 392 and tubing rotator 390 assembly is configured to be installed on the upper flange 361*a* of the tubing head. In this way, the integrated tubing hanger and tubing rotator can be fit on any of various tubing heads, without reference to the shape of inner surface 361*b*.

Tubing rotator 390 includes a rotator body 405 with an opening extending from its upper end to its lower end centered on a long axis x, a gasket seat 402 between the flange of the tubing head and the rotator body, a rotator bowl 404, a bull gear 406 through which the rotator bowl is driven to rotate about axis x, by a worm gear 406*a* within the rotator body and a bearing 370 on which the rotator bowl rotates, and which in this embodiment, is between rotator bowl 404 and gasket seat 402. There is an annular seal 403*a*, such an o-ring, in the interface between rotator bowl 404 and gasket seat 402.

Tubing hanger 392 is configured to support a tubing string and permits manipulation to tension the tubing string, such as to pull tension into the tubing string for actuation of an anchor or packer downhole. Tubing hanger 392 includes a mandrel 401 and an outer hanger body 417.

Mandrel 401 includes a connection 438*a* at its lower end such that, in use, the mandrel can be threadably connected to the tubing string. Threads 438*b* provided at the upper end of the mandrel 401 may be used for tensioning the tubing string, as explained subsequently.

The outer hanger body 417 has an outer diameter that can fit through the service rig BOP and the mandrel 401 has an outer diameter to fit through the rig tongs. These features allow the tubing hanger to be placed into the tubing head through the service rig BOP and the mandrel can be handled and torqued to the prescribed amount using the rig tongs to apply the correct torque and the tubing is prevented from rotation by the rig slips while the torque is applied.

The outer hanger body 417 has a main bore that accommodates mandrel 401. The outer hanger body herein comprises a hanger lower body 408 and a hanger upper body 412. The outer hanger body, including hanger lower body 408 and hanger upper body 412, are each annular and together encircle the mandrel in a concentric manner. In particular, hanger lower body 408 encircles the mandrel and is configured such that a shoulder is defined, which is sized and shaped to rest on another shoulder in the inner diameter of the rotator bowl 404. Seals 403*b*, such as elastomeric or wedge lock seals, are provided on the outer surface of the hanger lower body 408 and create an annular seal between the rotator bowl 404 and the outer hanger body 417. A plurality of these seals 403*b* can be provided to protect mechanisms, such as bearing 374. For example, one seal 403*b* can be installed to encircle the outer hanger body below the bearing 374 and another seal 403*b* can be installed to encircle the outer hanger body above the bearing 374.

As such, the assembly includes tubing rotator 390 supported on the tubing head flange 361*a*, outer hanger body 417 supported on and within the bore of the tubing rotator bowl 404 and inner mandrel 401 within the bore of, and supported on, the outer hanger body and indirectly supported on the tubing rotator and the tubing head.

The outer hanger body 417 and the mandrel 401 are releasably locked together by a J-lock mechanism discussed subsequently. Thus, when outer hanger body 417 is supported in the tubing rotator, J-lock mechanism ensures that mandrel 401 can also be supported within the outer hanger body. However, by manipulation of J-lock mechanism, mandrel 401 can be moved axially relative to the hanger outer body.

Figure 12:
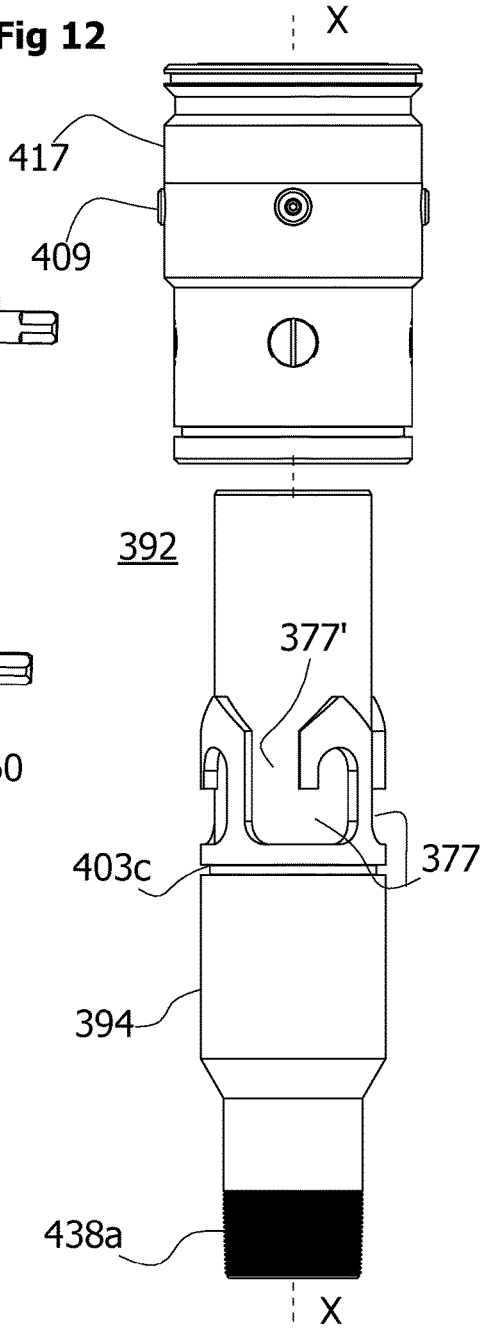
FIG. 12 is a side, exploded view of the tubing hanger from the assembly of FIG. 11.
Figure 13A:
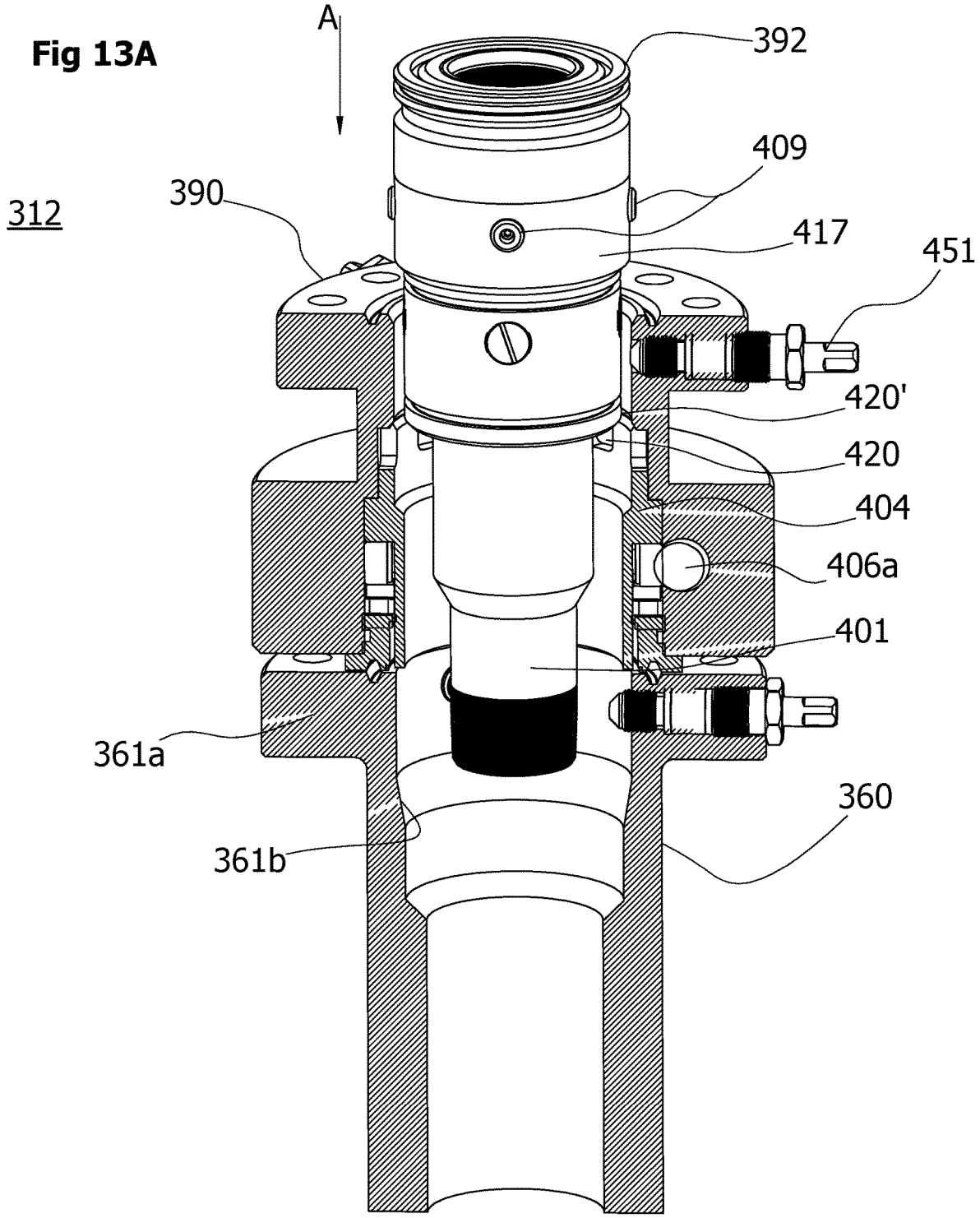
FIGS. 13A and 13B are a side view, partially in section, of the assembly of FIG. 11.
Figure 13B:
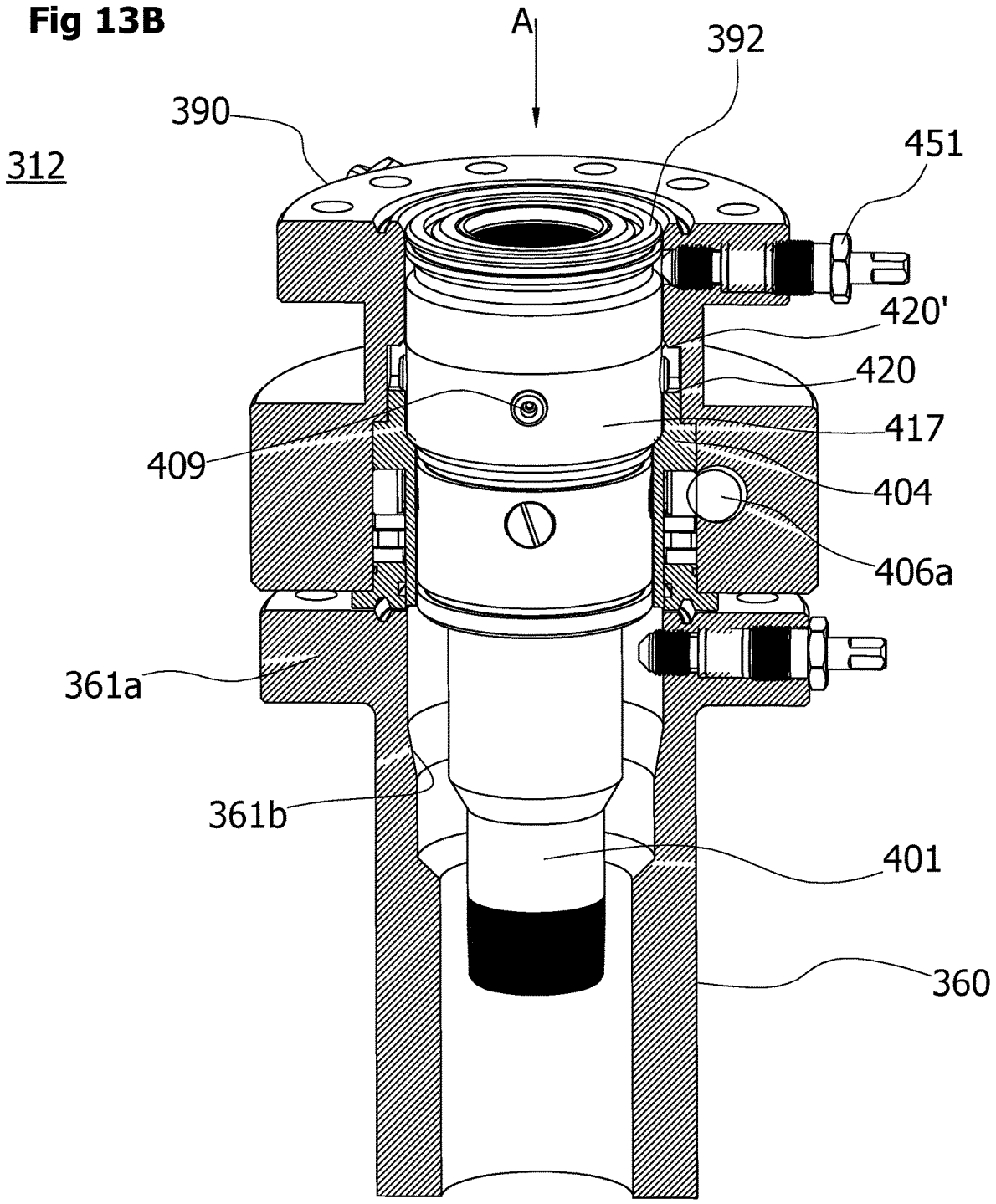
Figure 14:
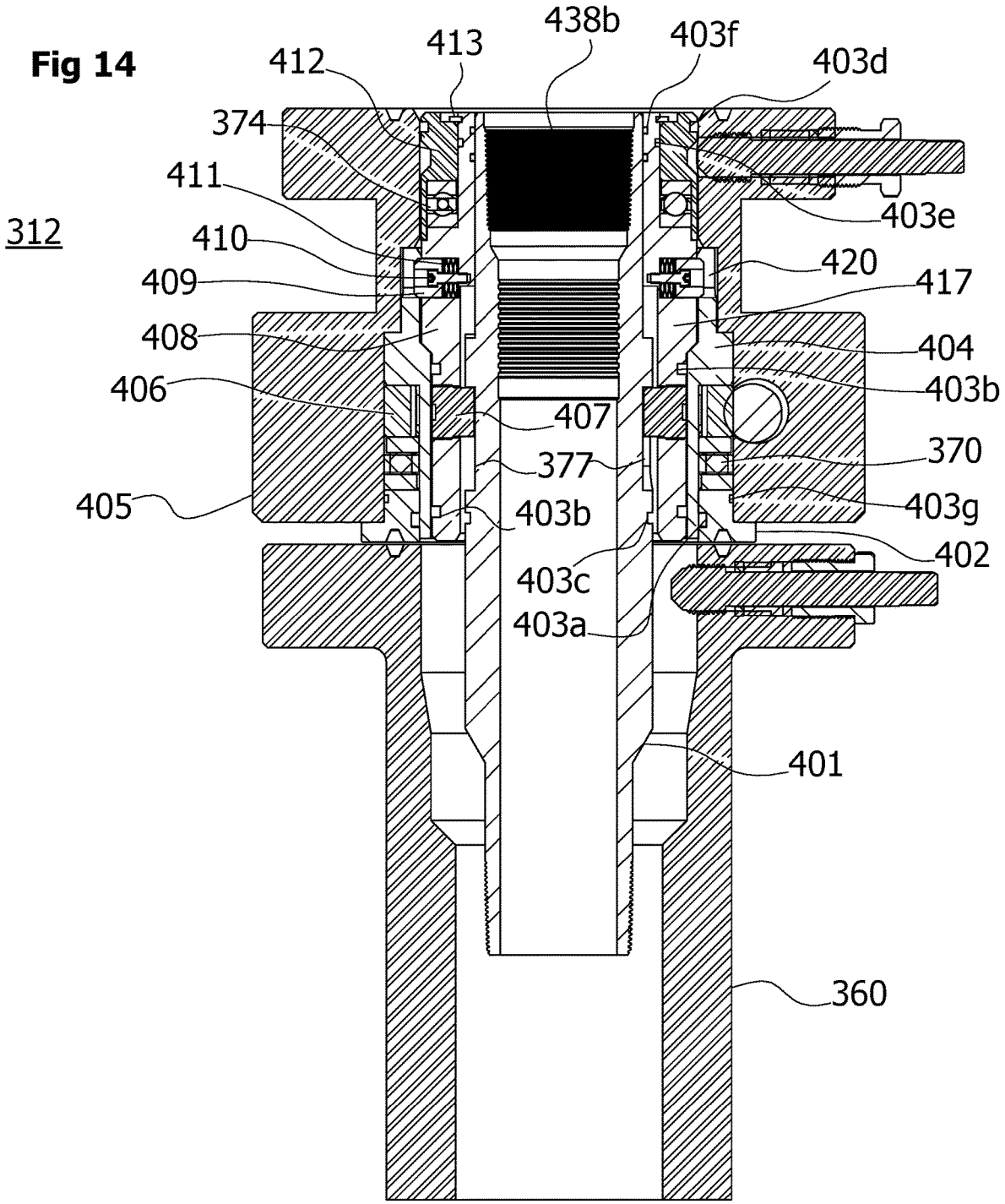
FIG. 14 is a sectional view through the assembly of FIG. 11.

The outer hanger body 417 and the inner mandrel 401 are rotationally and axially connected by a plurality of, for example four, circumferentially spaced J-lock connections. Each J-lock connection includes a pin 407 that rides in a slot 377, for example shaped like a J. The pins 407 for the J-connections are secured to the outer hanger body 417, while the corresponding J-slots 377 as shown in FIG. 12 are machined on the outside of the inner mandrel 401. The pins 407 may be threaded to the outer hanger body 417, or may otherwise be secured.

An annular deformable seal, such as an o-ring, is in a gland 403*c* that encircles mandrel 401 below J-slots 377. This seal against the main bore of outer hanger body 417 and prevents well fluids from migrating up between the mandrel and outer hanger body 417. While previous tubing hangers may configure the seals on outer hanger body, placement of the seal on the mandrel offers a number of benefits including ease of access for placement and repair and protection against damage by passing structures. For example, if the seals are in the ID of the outer hanger body, the seals may be damaged by structures such as the J-slots of the mandrel as the mandrel is moved up and down during string tensioning.

Using the J-lock mechanisms, a controlled amount of rotation applied to mandrel 401 may be used to reliably move the J-slots relative to the pins.

As disclosed herein, the J-lock pins 407 extend radially inward from and are fixed to the outer hanger body 417, and the corresponding J-slots 377 are provided in the inner mandrel 401. Pins 407 are positioned above seals 403*b* and 403*c*, so that the J-slot mechanism is positioned in the annulus sealed area. As such, pins 407 can extend through the radial thickness of the outer hanger body.

In this embodiment, J-slots 377 are formed with their openings 377' facing up. As such, mandrel 401 can be unhooked from the pins 407, by pulling up on the mandrel and rotating slightly. Then, the mandrel can be moved down in the well to disengage the slots from the pins. The mandrel can be moved down a certain distance below the outer hanger body and the anchor/packer can be set. Pulling the mandrel back to engage it onto the pins of the outer hanger body provides a certain amount of tension into the tubing string. Specifically, when the mandrel is moved up, the slots 377 can be aligned with the pins and the mandrel pulled up, rotated and set down to hook the terminal ends of the J-slots 377 onto the pins 407.

The mandrel is moved down in the well to a depth sufficient to manipulate the packer/anchor and adjust the tension of the tubing string connected thereto. Such movement moves the J-slots down significantly in the well, for example, below the outer hanger body 417. The actual depth varies but typically, the string is moved one to twenty feet, for example three to five feet for a #2⅞ tubing, down into the well before being pulled up and tensioned.

While some previous tubing hangers with tensioning capabilities provide limited well control options during tensioning, the present embodiment of mandrel 401 can be attached to outer hanger body 417 and can be suspended from a handling sub and both can be introduced together into the tubing head through the service rig BOP, thus providing well control. In particular, most prior systems cannot be tensioned with the service rig BOP in place. Removing the service rig BOP and then extending the mandrel below the outer hanger body means that well fluids can then escape between the tubing and the outer hanger body. Water is typically added to suppress the well pressure but gas can percolate through the water and break into the space between the tubing and outer hanger body, thus creating the possibility of a well blowout. The present invention allows the service rig BOP to remain connected to the wellhead and the mandrel to be manipulated by a handling joint extending through. If gas or fluid starts to escape, the service rig BOP can be closed around the handling joint to prevent pressurized gases and fluids from escaping. Then water can be added through the tubing head ports to "kill" the well before any further manipulation is attempted.

The outer hanger body 417 includes parts that permit the mandrel to receive and transmit a rotary drive from a tubing rotator, while the pins 407 and J-slots 377 are engaged. For example, in one embodiment (best seen in FIGS. 13 and 14) outer hanger body 417 can include an engagement torque pin 409 that is secured by a cap screw 410 to the hanger lower body 408 and biased radially outwardly by a spring such as a wave spring 411. Engagement torque pin 409 is configured to be meshed and to rotate with rotator bowl 404. In particular, the upper end of rotator bowl 404 has a number of teeth 420 into which the torque pins 409 can land and mesh. During rotation of rotator bowl 404 by worm gear 406*a*, the teeth 420 drive against engagement torque pins 409 to rotate the hanger lower body 408.

Figure 15:
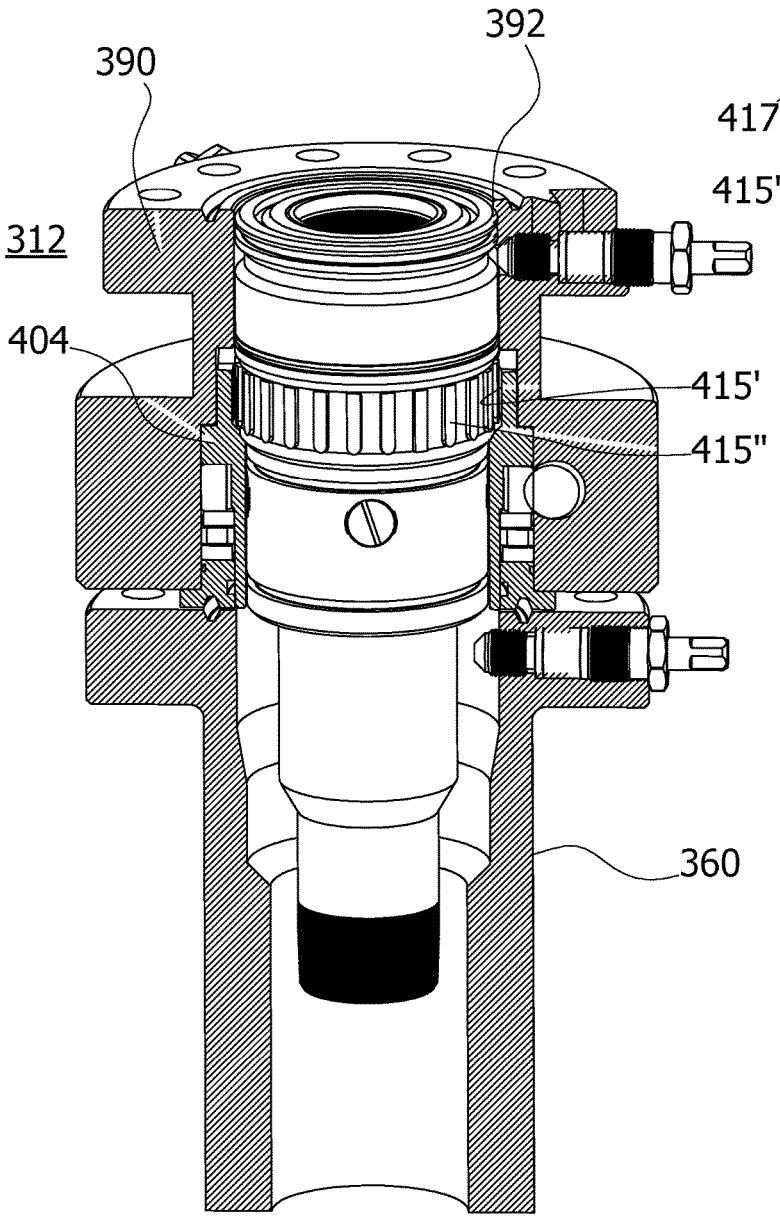
FIG. 15 is a side view, partially in section, of wellhead installation including a tubing head and, installed thereon, another assembly for rotatably supporting a tubing string in the well and operable for tensioning the tubing string.
Figure 15A:
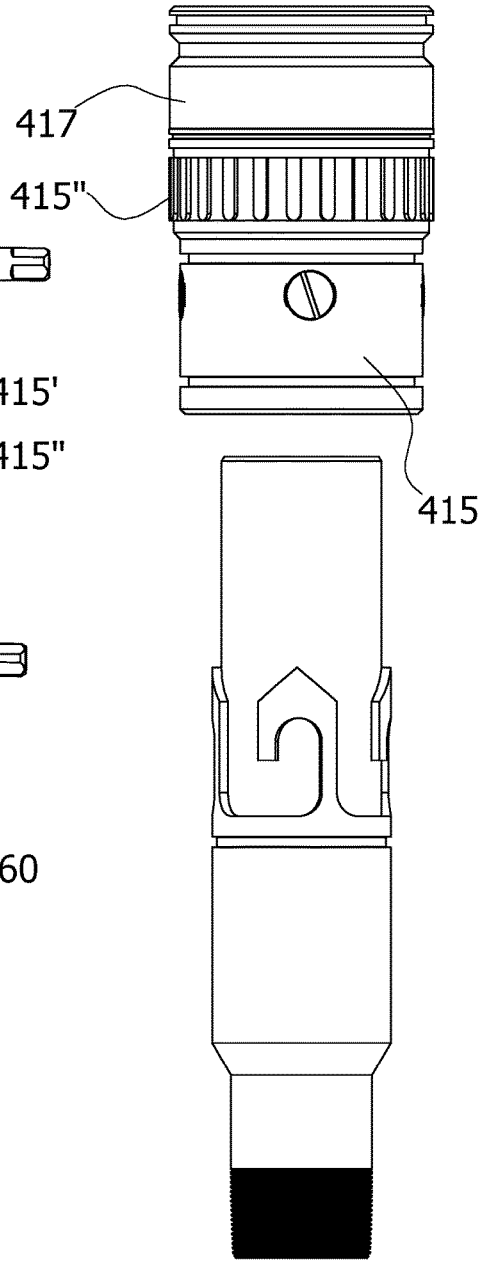
FIG. 15A is a side, exploded view of the tubing hanger from the assembly of FIG. 15.
Figure 16:
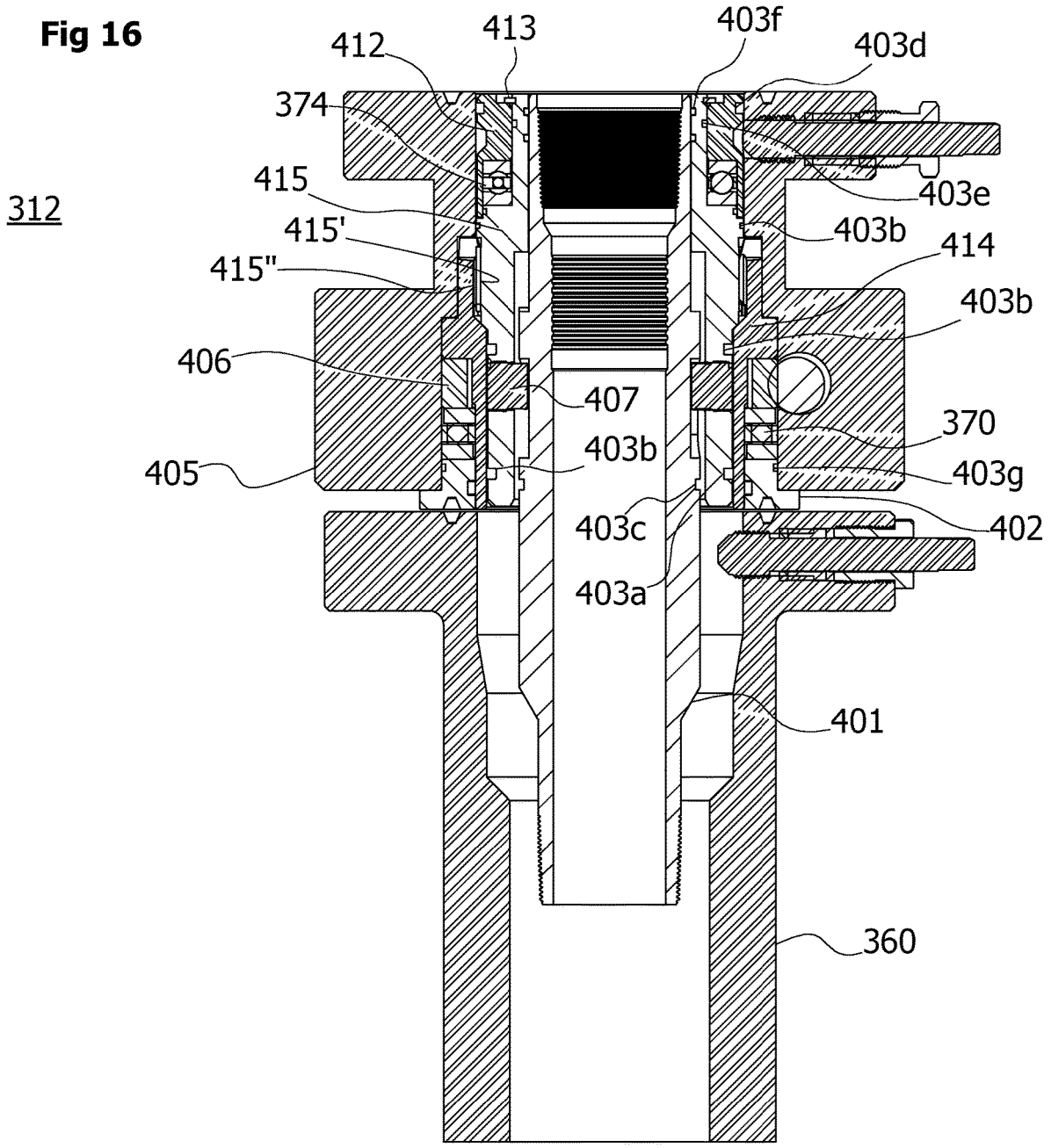
FIG. 16 is a sectional view through the assembly of FIG. 15.

The engagement torque pins are spring loaded so they pop out into teeth 420 when they are lined up. Once engaged with the teeth, they transmit torque from the rotator bowl to the outer hanger body. Other types of torque transmission from the rotator mandrel to the outer hanger body are possible such as splines, teeth, keys, slots and other means of transmitting torque. An installation 312 is illustrated in FIGS. 15, 15A and 16 with an assembly of tubing hanger 392 and tubing rotator 390, wherein there are interacting splines 415', 415" on rotator bowl 404 and a lower portion 415 of outer hanger body 417, respectively. A seal 403*b* can be installed to encircle the outer hanger body above splines 415" to protect the splines against debris, which might otherwise migrate down and jam the splines.

Hold down screws 451 hold the assembly down. In particular, hold down screws 451 hold outer hanger body 417 axially in, against lifting out of engagement with, rotator bowl 404. In particular, when in place, screws 451 are threaded radially inwardly to engage in an annular shoulder in the upper hanger body 412. As such, screws 451 resist axial separation of hanger outer body 417 and rotator bowl 404 by axially upward forces.

As noted, outer hanger body 417 includes hanger upper body 412 and hanger lower body 408, which are secured together via a snap ring 413. Bearing 374 prevents damage to the upper hanger body since it eliminates relative motion between the hold down screws and upper hanger body, while lower hanger body 408 can rotate with bowl 420.

To protect bearing 374, it is enclosed between hanger upper body 412 and hanger lower body 408 such that it is not exposed in the main bore of the outer body. Therefore, bearing 374 is not exposed to wear and damage of the mandrel being moved therepast and is protected from debris accumulating above the tubing hanger. In particular, a sleeve portion of the hanger lower body extends up through a bore in the hanger upper body. The bearing is positioned between the hanger upper body 412 and hanger lower body 408 and behind, or in other words radially outwardly of, the upwardly extending sleeve portion of the hanger lower body. Seals 403*d*, 403*e* are positioned are positioned on the inner and outer diameters of hanger upper body above bearing 374 so that well fluids and debris cannot migrate down into the bearing.

Seals 403*f* also encircle the upper end of mandrel 401 so that well fluids and debris cannot migrate down between the mandrel and the outer hanger body.

As with bearing 374, bearing 370 and gear 406 are also protected by enclosure in their respective parts and/or by seals. Bearing 370 and gear 406, for example, are enclosed within an outer diameter of bowl 404 and the rotator body bore. Seals 403*a* protect against infiltration of debris. Bearing 370 and gear 406 stay in place while tubing, anchors, pumps, centralizers and tubing is run in and out of the hole so the protection is very important.

In summary, the integrated tubing rotator and tubing hanger provides an effective but simple solution to tubing operations including tensioning. The key features are:

The assembly has only four key parts: the rotator body with the rotator drive gear, the rotator bowl driven by the drive gear, the outer hanger body supported on and driven by the rotator bowl and the mandrel supported on and rotated with the outer hanger body; and The assembly has an integrated hanger bowl;

The assembly is installed above the tubing head and all support and rotation structures are above the tubing head, therefore the assembly is substantially independent of the tubing head. Thus the assembly is useful over a number of different styles and sizes of tubing connections and of tubing heads; and Full casing bore access is achieved by simply pulling up on the mandrel, which lifts the tubing hanger mandrel and outer hanger body up out of engagement with the integrated hanger bowl and rotator.

Because the rotator engages through the hanger outer body to the outer surface of the mandrel the upper end of the mandrel remains open for access to the mandrel's inner bore and, therethrough, to the string inner diameter, even when the rotator is in place and functioning.

Using the surface equipment disclosed herein, the tubing string attached to the lower end of the mandrel 401 may be manipulated by axial pull or set-down weight, to set an anchor or packer at the lower end of the tubing string.

To install the tubing hanger, rotator body 405 and rotator bowl 404 are installed on the tubing head. The tubing is run in through the rotator bowl and rotator body. After the tubing is run in, the mandrel is connected to the last joint of the string and the tubing string is supported on the rig slips. The rig tong is then applied to the mandrel to torque the connection to the tubing according to the required specification. The handling joint is then removed from the mandrel and the outer hanger body 417 is then put onto the mandrel and hooked onto the hanger outer body 417 via the J-lock connections 407, 377. The handling sub is then reconnected to the mandrel and lifts the mandrel, outer hanger body and tubing string to release the rig slips. The assembly is then lowered through the rig BOP until the outer hanger body is seated into the rotator bowl 404.

In this process, torque pins 409 collapse to pass through the upper end of the rotator bore and then expand out into the teeth of rotator bowl 404 and below the shoulder 420' in the rotator bore. When the rotator starts to turn, the torque pins pop out engage with the slots between teeth 420 of the rotator mandrel and the tubing then starts to turn.

The hold down screws 451 are then secured to lock the outer hanger body 417 in place. The handling joint, and thereby mandrel 401, is then raised and rotated to disengage the J-lock connection 407, 377 and the tubing string is lowered a prescribed amount that is calculated to provide the required amount of tension to the tubing string. The anchor or packer is then set. Pulling the tubing string back up and latching the mandrel into the J-lock locks in the tension and that tension can be verified by reading the string weight from the rig's weight indicator.

At any time, a joint may be threaded to engage the threads at the upper end of inner mandrel 401, the J-lock can be disengaged, tubing tension can be released, and the downhole anchor can be released and reset at a new distance to achieve a different tension. A substantial amount of tension may thus be obtained, and the J-lock mechanism locks that tension in the tubing string. Once tensioned at the desired level, the rotator 390 is activated to rotate the mandrel and therethrough, the tensioned tubing string.

It should be apparent that the present invention allows for tubing tensioning after the tubing string is anchored and the tensioned tubing string then rotated by a tubing rotator. In a reverse operation, tension may be released to remove the anchor. All tensioning operations may occur while the rotator remains in place. The present invention also allows full access to the tubing string, and allows the tubing string to be set with various types of anchors, which requires push/pull or rotational operations of the tubing string.

General

With respect to the J-lock mechanisms, the term "pin" as used herein intended to cover not only elongate generally cylindrical pins that commonly fit within slots, but also other structurally similar devices, which do not have a generally cylindrical configuration and may be termed "fins." Also, the pins or fins may be spring biased so that they move radially to extend into a slot when properly aligned. To release the tubing anchor, the tool may be inserted to retract the pins out of the slots. As will be appreciated from the embodiments illustrated, the configuration of a slot may be other than a J, and similar pin-slot mechanisms may be termed E-slots, F-slots, G-slots, M-slots, or W-slots.

Although specific embodiments of the invention have been described herein in some detail, this has been done solely for the purposes of explaining the various aspects of the invention, and is not intended to limit the scope of the invention as defined in the claims that follow. Those skilled in the art will understand that the embodiment shown and described is exemplary, and various other substitutions, alterations and modifications, including but not limited to those design alternatives specifically discussed herein, may be made in the practice of the invention without departing from its scope.

The invention claimed is:

1. A tubing hanger comprising:

an outer hanger body for supporting the tubing hanger in a tubing head, the outer hanger body including a support portion, a rotatable portion and a bearing permitting rotation of the rotatable portion relative to the support portion; and a mandrel for connection to a tubing string, the mandrel supported in a main bore of the outer hanger body by J-lock mechanisms between the mandrel and the rotatable portion, the mandrel having an upper end configured for engagement with a tubing rotator, wherein each J-lock mechanism includes:

a J-slot on the mandrel; and a pin protruding inwardly in the main bore of the outer hanger body, for moving along the J-slot; and wherein the J-slot includes:

a hanging location where the J-slot is hung on the pin;

an entry opening leading to the hanging location; and an exit opening extending away from the hanging location and that is separate from the entry opening.

2. The tubing hanger of claim 1 wherein in a position with the J-lock mechanisms engaged between the mandrel and the outer hanger body, the mandrel protrudes above the outer hanger body.

3. The tubing hanger of claim 1, wherein the J-slot further comprises: a ratcheting ring that forms a bottom limit of the J-slot, wherein the ratcheting ring is configured to act with the pin to drive rotation of the mandrel relative to the outer hanger body for alignment of the pin and the J-slot.

4. The tubing hanger of claim 3, wherein the ratcheting surface includes a plurality of notches, each notch having a ramped sidewall that is angled away from a point closest to the hanging location, towards a depth of the notch and a first notch is positioned with the ramped side wall axially below and aligned with the entry opening and a second notch is positioned with the ramped side wall axially below and aligned the hanging location.

5. A tubing hanger comprising: a mandrel for connection to a tubing string; an outer hanger body for supporting the tubing hanger in a tubing head, the mandrel supported in a main bore of the outer hanger body by J-lock mechanisms; an annular seal to seal against fluid flow up between the outer hanger body and the mandrel; and a lower extension sleeve coupled to and extending below the outer hanger body and the annular seal remains set between the mandrel and the lower extension sleeve, when the mandrel is lowered to a position below the supported position to a tubing string tensioning position.

6. A tubing hanger comprising: a mandrel for connection to a tubing string; an outer hanger body for supporting the tubing hanger in a tubing head, the mandrel supported in a main bore of the outer hanger body by J-lock mechanisms; and an annular seal to seal against fluid flow up between the outer hanger body and the mandrel, wherein: the outer hanger body includes a support portion, a rotatable portion and a bearing permitting rotation of the rotatable portion relative to the support portion, and wherein the rotatable portion includes a sleeve extension extending down within a bore of the support portion and the bearing is enclosed between the rotatable portion and the support portion and radially outwardly and behind the sleeve extension.

7. A tubing hanger and rotator assembly comprising:

a tubing rotator body including:

a lower flange connection configured to secure to a tubing head flange connection;

a bore extending from an upper end of the tubing rotator body and through the lower flange connection, the bore defining a long axis; and a rotator gear communicating with the bore;

a rotator bowl supported in the bore and in communication with the rotator gear and configured to be rotated about the long axis by the rotator gear; and a tubing hanger including:

an outer hanger body supportable in the rotator bowl and configured to be rotated about the long axis with the rotator bowl; and a mandrel for connection to a tubing string, the mandrel supported in a main bore of the outer hanger body by J-lock mechanisms configured such that the mandrel is disengageable from the outer hanger body and lowerable through the outer hanger body into a tubing string tensioning position, wherein each J-lock mechanism includes:

a J-slot on the mandrel; and a pin protruding inwardly in the main bore of the outer hanger body, for moving along the J-slot; and wherein the J-slot includes:

a hanging location where the J-slot is hung on the pin;

an entry opening leading to the hanging location; and an exit opening extending away from the hanging location and that is separate from the entry opening.

8. The tubing hanger and rotator assembly of claim 7, wherein the J-slot further comprises: a ratcheting ring that forms a bottom limit of the J-slot, wherein the ratcheting ring is configured to act with the pin to drive rotation of the mandrel relative to the outer hanger body for alignment of the pin and the J-slot.

9. The tubing hanger and rotator assembly of claim 8, wherein the ratcheting surface includes a plurality of notches, each notch having a ramped sidewall that is angled away from a point closest to the hanging location, towards a depth of the notch and a first notch is positioned with the ramped side wall axially below and aligned with the entry opening and a second notch is positioned with the ramped side wall axially below and aligned the hanging location.

10. A tubing hanger comprising:

an outer hanger body for supporting the tubing hanger in a well head installation, the outer hanger body including a main bore; and a mandrel for connection to a tubing string, the mandrel supported in a main bore of the outer hanger body by a J-lock mechanism between the mandrel and the main bore, wherein the J-lock mechanism includes:

a J-slot on the mandrel; and a pin protruding inwardly in the main bore, for moving along the J-slot; and wherein the J-slot includes:

a hanging location where the J-slot is hung on the pin;

an entry opening leading to the hanging location; and an exit opening extending away from the hanging location that is separate from the entry opening.

11. The tubing hanger of claim 10, wherein the J-slot further comprises: a ratcheting ring that forms a bottom limit of the J-slot, wherein the ratcheting ring is configured to act with the pin to drive rotation of the mandrel relative to the outer hanger body for alignment of the pin and the J-slot.

12. The tubing hanger of claim 11, wherein the ratcheting ring includes a plurality of notches, each notch having a ramped sidewall that is angled away from a point closest to the hanging location, towards a depth of the notch and a first notch is positioned with the ramped side wall axially below and aligned with the entry opening and a second notch is positioned with the ramped side wall axially below and aligned the hanging location.

* * * * *